US009951564B1

(12) United States Patent
Cox et al.

(10) Patent No.: US 9,951,564 B1
(45) **Date of Patent: *Apr. 24, 2018**

(54) ROTATIONAL DRILL BITS AND DRILLING APPARATUSES INCLUDING THE SAME

(71) Applicant: Dover BMCS Acquisition Corporation, Orem, UT (US)

(72) Inventors: E. Sean Cox, Spanish Fork, UT (US); Nathan Andrew Tulett, Orem, UT (US)

(73) Assignee: DOVER BMCS ACQUISITION CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/887,311

(22) Filed: Oct. 19, 2015

Related U.S. Application Data

(63) Continuation of application No. 13/840,702, filed on Mar. 15, 2013, now Pat. No. 9,194,187.

(51) Int. Cl.
*E21B 10/26* (2006.01)
*E21B 10/54* (2006.01)
*E21B 10/60* (2006.01)

(52) U.S. Cl.
CPC ..... *E21B 10/26* (2013.01); *E21B 10/54* (2013.01); *E21B 10/60* (2013.01)

(58) Field of Classification Search
CPC ..... E21B 10/26
See application file for complete search history.

(56) References Cited

U.S. PATENT DOCUMENTS

| | | | |
|---|---|---|---|
| 1,532,330 | A | 4/1925 | Mitchell |
| 2,578,593 | A | 12/1951 | Phipps |
| 4,189,013 | A | 2/1980 | Adams et al. |
| 4,190,128 | A | 2/1980 | Emmerich et al. |
| 4,330,044 | A | 5/1982 | Orr et al. |
| 4,446,936 | A | 5/1984 | Sarin et al. |
| 4,488,609 | A | 12/1984 | Sarin |

(Continued)

OTHER PUBLICATIONS

Partial International Search Report cited in PCT Notice of Invitation to Pay Additional Fees, and Where Applicable, Protest Fee dated Mar. 5, 2015 in corresponding International Application No. PCT/US2014/028870 with the International Filing Date of 14 Ma.

(Continued)

*Primary Examiner* — Giovanna C Wright
(74) *Attorney, Agent, or Firm* — Fisherbroyles, LLP

(57) ABSTRACT

A subterranean support-bolt drilling assembly has a drill bit rotatable about a central axis and including at least one cutting edge. The drilling assembly also includes a spacer coupled to a rearward end of the drill bit. A reamer member is coupled to a rearward end of the spacer, the reamer member having at least one cutting element, the at least one cutting element having a cutting edge that extends radially beyond an outer peripheral portion of the drill bit relative to the central axis. A subterranean support-bolt drill bit includes a bit body and at least one cutting element coupled to the bit body. The support-bolt drill bit has a central pilot extending from the bit body in an axially forward direction. The cutting edge of the at least one cutting element extends radially beyond the central pilot relative to a central axis of the drill bit.

20 Claims, 11 Drawing Sheets

(56) References Cited

U.S. PATENT DOCUMENTS

| | | | | |
|---|---|---|---|---|
| 4,492,278 | A | 1/1985 | Leighton | |
| 4,515,230 | A | 5/1985 | Means et al. | |
| 4,527,931 | A | 7/1985 | Sarin | |
| 4,550,791 | A | 11/1985 | Isakov | |
| 4,605,079 | A | 8/1986 | Leibee et al. | |
| 4,712,626 | A | 12/1987 | Shaw | |
| 5,180,022 | A | 1/1993 | Brady | |
| 5,220,967 | A | 6/1993 | Monyak | |
| 5,287,937 | A | 2/1994 | Sollami et al. | |
| 5,303,787 | A | 4/1994 | Brady | |
| 5,429,199 | A | 7/1995 | Sheirer et al. | |
| 5,452,628 | A | 9/1995 | Montgomery, Jr. et al. | |
| 5,458,210 | A | 10/1995 | Sollami | |
| 6,026,918 | A | 2/2000 | Briese | |
| 6,145,606 | A | 11/2000 | Haga | |
| 6,349,780 | B1 * | 2/2002 | Beuershausen | E21B 10/55 175/408 |
| 6,586,862 | B1 | 7/2003 | Cselle | |
| 6,684,968 | B2 | 2/2004 | Bise et al. | |
| 6,915,867 | B2 | 7/2005 | Bise | |
| 9,194,187 | B2 * | 11/2015 | Cox | E21B 10/26 |
| 2007/0119624 | A1 | 5/2007 | Brady | |
| 2007/0119625 | A1 | 5/2007 | Brady | |
| 2007/0274788 | A1 | 11/2007 | Ravat | |
| 2009/0000828 | A1 | 1/2009 | Hall et al. | |
| 2009/0285638 | A1 | 11/2009 | Lundberg et al. | |
| 2011/0284294 | A1 | 11/2011 | Cox et al. | |
| 2011/0297451 | A1 * | 12/2011 | Cox | E21B 10/602 175/428 |
| 2013/0213717 | A1 * | 8/2013 | Bise | E21B 10/26 175/388 |

OTHER PUBLICATIONS

International Search Report and Written Opinion dated Jul. 1, 2015 in corresponding International Application No. PCT/US2014/028870 with the International dated Mar. 14, 2014.

* cited by examiner

ROTATIONAL DRILL BITS AND DRILLING APPARATUSES INCLUDING THE SAME

CROSS-REFERENCE TO RELATED APPLICATIONS

This application is a continuation of U.S. patent application Ser. No. 13/840,702 titled "Rotational Drill Bits and Drilling Apparatuses Including the Same" and filed 15 Mar. 2013, which is hereby incorporated by reference in its entirety.

BACKGROUND

Cutting elements are traditionally utilized for a variety of material removal processes, such as machining, cutting, and drilling. For example, tungsten carbide cutting elements have been used for machining metals and on drilling tools for drilling subterranean formations. Similarly, polycrystalline diamond compact (PDC) cutters have been used to machine metals (e.g., non-ferrous metals) and on subterranean drilling tools, such as drill bits, reamers, core bits, and other drilling tools. Other types of cutting elements, such as ceramic (e.g., cubic boron nitride, silicon carbide, and the like) cutting elements, or cutting elements formed of other materials have also been utilized for cutting operations.

Drill bit bodies to which cutting elements are attached are often formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body.

In some situations, drill bits employing cutting elements may be used in mining environments to drill bolt holes in subterranean formations. Various types of cutting elements, such as PDC cutters, have been employed for drilling boreholes for subterranean support bolts. Although other configurations are known in the art, PDC cutters often comprise a substantially cylindrical or semi-cylindrical diamond "table" formed on and bonded under high-pressure and high-temperature (HPHT) conditions to a supporting substrate, such as a cemented tungsten carbide (WC) substrate.

Subterranean-bolt holes may accommodate support bolts, such as roof bolts, face bolts, or rib bolts, for securing subterranean formations. For example, in underground mining operations, such as coal mining, tunnels are formed underground. In order to make the tunnels safe for use, the roofs of the tunnels must be supported in order to reduce the chances of a roof cave-in and/or to block various debris falling from the roof. In order to support a roof in a mine tunnel, boreholes are typically drilled into the roof using a drilling apparatus. The drilling apparatus commonly includes a drill bit attached to a drilling rod (such as a drill steel). Roof bolts are inserted into the boreholes to secure a roof portion. In some situations, the roof bolts may be used to anchor a support panel or screen to the roof. Support bolts may also be utilized to secure other portions of a mining tunnel, such coal ribs/pillars, side faces, and floors.

Commonly, drilled boreholes may be filled with a resin prior to inserting the bolts, or the bolts may have self expanding portions, in order to anchor the bolts to the roof. Threaded bolts may be problematic to use for securing subterranean features due to their long lengths. Subterranean support bolts commonly extend to eight feet or more in order to adequately secure the formations. Driving a threaded bolt the entire length of a corresponding borehole would require a significant amount of time and energy. Alternatively, widening a portion of the borehole to accommodate a partially threaded bolt, such as a lag bolt, would require multiple drilling operations to be performed using different diameter drill bits in order to bore a single bolt hole, resulting in wasted time and resources.

Often, boreholes for support bolts, such as roof bolts, are drilled into a subterranean formation in a direction that is generally perpendicular to the surface of the formation. Alternatively, a borehole may be drilled at a non-perpendicular angle with respect to the formation surface. For example, a support bolt may extend at an angle through a portion of a coal rib and into an adjacent portion of the roof, thereby stabilizing the coal rib. Unfortunately, starting drilling of a borehole at an angle with respect to a subterranean surface is often difficult since the shape of the drill bit may cause the drill bit to "walk" or wander across the surface, rather than remaining centered at a desired point on the surface.

SUMMARY

The instant disclosure is directed to exemplary roof-bolt drill bits. In some embodiments, a subterranean support-bolt drilling assembly may comprise a drill bit rotatable about a central axis, the drill bit having a forward end and a rearward end axially spaced away from the forward end, and the drill bit comprising at least one cutting edge. The drilling assembly may include a spacer coupled to the rearward end of the drill bit, the spacer extending axially rearward from the drill bit. In at least one embodiment, the spacer may have a length in the axial direction that is longer than the drill bit in the axial direction. The drilling assembly may also include a reamer member coupled to a rearward end of the spacer, the reamer member comprising at least one cutting element, the at least one cutting element comprising a cutting edge that extends radially beyond an outer peripheral portion of the drill bit relative to the central axis. The at least one cutting element may comprise a superabrasive material such as polycrystalline diamond.

According to at least one embodiment, the drill bit and the spacer may have a combined length of approximately 12 inches or more in the axial direction. A maximum diameter of the reamer member may exceed a maximum diameter of the drill bit by approximately 1 mm or more with respect to the central axis. In some embodiments, the drill bit may include at least one cutting element coupled to a bit body, the at least one cutting element of the drill bit comprising the at least one cutting edge of the drill bit. The at least one cutting element of the drill bit may be positioned adjacent the central axis such that the drill bit does not generate a core in a borehole created by the rotary drill bit during drilling.

A subterranean support-bolt drill bit may comprise a bit body rotatable about a central axis, the bit body having a forward end and a rearward end axially spaced away from the forward end, and at least one cutting element coupled to the bit body, the at least one cutting element comprising a cutting edge. The drill bit may also comprise a central pilot extending from the bit body in an axially forward direction, the central pilot comprising a cutting edge. The cutting edge of the at least one cutting element may extend radially beyond the central pilot relative to the central axis. The central pilot may also comprise at least one forward cutting element, the cutting edge of the central pilot including a portion of the at least one cutting element. The at least one forward cutting element may be axially spaced away from the forward end of the bit body. According to at least one embodiment, the central pilot may have a length of approximately 0.5 inches or more in the axial direction.

In some embodiments, the at least one forward cutting element may comprise a plurality of cutting elements spaced substantially equally about the central axis. According to additional embodiments, the at least one forward cutting element may comprise a single cutting element intersecting the central axis. The central pilot may be integrally formed with the bit body. The central pilot may be secured within a recess extending through at least a portion of the bit body. In some embodiments, at least a portion of the central pilot may have a generally cylindrical periphery. At least a portion of the central pilot may comprise a superabrasive material, such as polycrystalline diamond. At least a portion of the central pilot may additionally or alternatively comprise a carbide material. According to at least one embodiment, the drill bit may comprise a coupling shank extending generally parallel to the central axis. The central pilot may be connected to the coupling shank by a connection member extending through a hole defined in the bit body.

According to some embodiments, a subterranean support-bolt drilling assembly may comprise a drill steel and a drill bit mounted to the drill steel. The drill bit may comprise a bit body rotatable about a central axis, the bit body having a forward end and a rearward end axially spaced away from the forward end, and at least one cutting element coupled to the bit body, the at least one cutting element comprising a cutting edge. The drill bit may also comprise a central pilot extending from the bit body in an axially forward direction, the central pilot comprising a cutting edge, the cutting edge of the at least one cutting element extending radially beyond the central pilot relative to the central axis.

Features from any of the disclosed embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
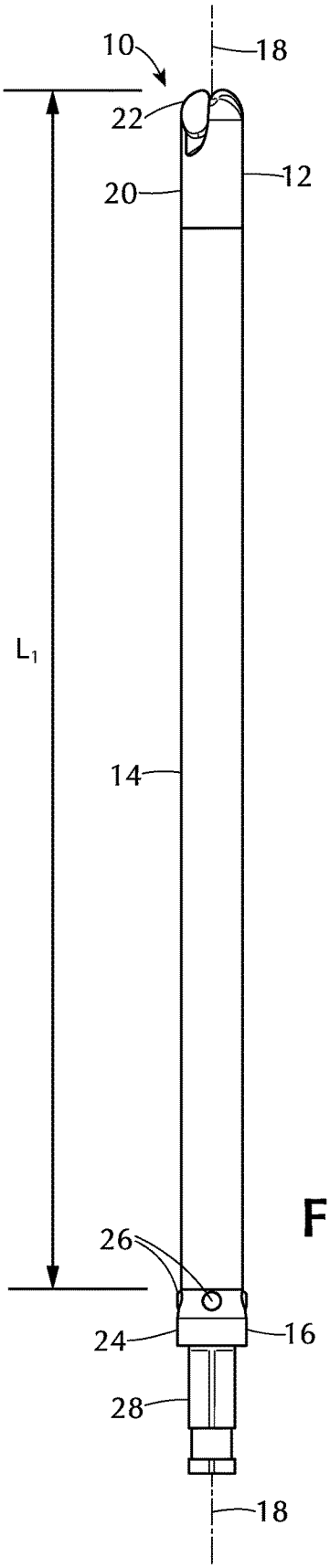
FIG. 1 is a side view of an exemplary drilling assembly according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary rotary drill bits for drilling formations in various environments, including wet-drilling and dry-drilling environments. For example, a rotary drill bit may be coupled to a drill steel and rotated by a rotary drilling apparatus configured to rotate the rotary drill bit relative to a subterranean formation. The phrase "wet-drilling environment," as used herein, may refer to drilling operations where drilling mud, water, and/or other drilling lubricants are supplied to a drill bit during cutting or drilling operation. In contrast, the phrase "dry-drilling environment," as used herein, may refer to drilling operations that do not utilize drilling mud or other liquid lubricants during cutting or drilling operations. For ease of use, the word "cutting," as used in this specification and claims, may refer broadly to machining processes, drilling processes, boring processes, or any other material removal process.

FIG. 1 is a side view of an exemplary support-bolt drilling assembly 10 according to at least one embodiment. Drilling assembly 10 may represent any type or form of subterranean earth-boring or drilling tool, including, for example, a rotary borehole drilling assembly. Components of drilling assembly 10 may be formed of any material or combination of materials, such as steel, molded tungsten carbide, and or polycrystalline diamond, without limitation. As illustrated FIG. 1, drilling assembly 10 may comprise a drill bit 12, a spacer 14, and a reamer member 16. Drilling assembly 10 may extend longitudinally so as to be centered about a central axis 18. While drill bit 12, spacer 14, and reamer member 16 may be depicted as separate components coupled together in drilling assembly 10, in some embodiments, drill bit 12, spacer 14, and/or reamer member 16 may be integrally formed with each other.

Drill bit 12 of drilling assembly 10 may comprise any type of drill bit suitable for drilling in wet-drilling environments and/or dry-drilling environments, without limitation. According to at least one embodiment, drill bit 12 may comprise a bit body 20 and at least one cutting element 22 coupled to bit body 20. As shown in FIG. 1, drill bit 12 may be centered about central axis 18.

Spacer 14 may be coupled to drill bit 12. Spacer 14 may be centered about central axis 18 and may extend longitudinally along central axis 18. In some embodiments, spacer 14 may comprise a substantially elongated and/or cylindrical shaft. Spacer 14 may have a maximum diameter that is less than or approximately the same as a maximum diameter of drill bit 12.

Reamer member 16 may be coupled to spacer 14 at an end of spacer 14 that is axially opposite drill bit 12. Reamer member 16 may be centered about central axis 18. Reamer member 16 may include a reamer body 24 and at least one cutting element 26 coupled to reamer body 24. In some embodiments, reamer member 16 may also include a rearward coupling portion 28, which may include, for example, a shank extending along central axis 18.

Figure 2:
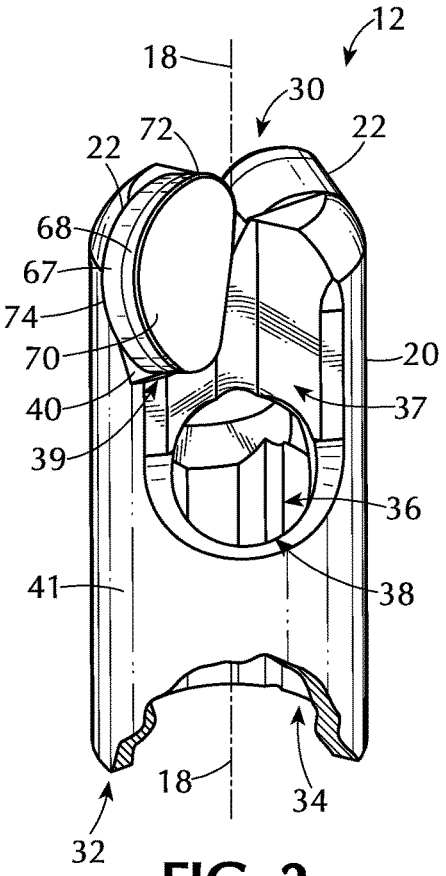
FIG. 2 is a partial cut-away perspective view of an exemplary drilling assembly according to at least one embodiment.

FIG. 2 shows a perspective view of an exemplary drill bit 12 which may be utilized in support-bolt drilling assembly 10 illustrated in FIG. 1. As shown in FIG. 2, support-bolt drill bit 12 may comprise a bit body 20 having a forward end 30 and a rearward end 32. At least one cutting element 22 may be coupled to bit body 20. For example, as shown in FIG. 2, a plurality of cutting elements 22 may be coupled to forward end 30 of bit body 20. Cutting elements 22 may be coupled to bit body 20 using any suitable technique, including, for example, mechanical attachment, brazing, or welding. According to some examples, a back surface 74 of each cutting element 22 may be mounted and secured to a corresponding mounting surface 40 on bit body 20.

In at least one embodiment, an internal passage 36 may be defined within bit body 20. As illustrated in FIG. 2, internal passage 36 may extend from a rearward opening 34 defined in rearward end 32 of bit body 20 to at least one side opening 38 defined in a side portion of bit body 20. In one embodiment, internal passage 36 may be configured to draw debris, such as rock cuttings, away from cutting elements 22. For example, a vacuum source may be attached to rearward opening 34 of internal passage 36 to draw cutting debris away from cutting elements 22 and through side opening 38 into internal passage 36.

In some embodiments, bit body 20 may have a peripheral side surface 41 defining an outer periphery of bit body 20. In some examples, peripheral side surface 41 may comprise a generally cylindrical shape. Peripheral side surface 41 may also comprise any other suitable shape and/or configuration, without limitation. Peripheral side surface 41 may extend to a radial distance that is less than or approximately the same as outer portions of cutting elements 22, such as portions of the cutting edges. At least one debris channel 37 may be defined in bit body 20 to guide debris, such as rock cuttings, into internal passage 36. Debris channel 37 may be formed in a variety of shapes and sizes, such as the substantially concave shape illustrated in FIG. 2. In one embodiment, debris channel 37 may be disposed adjacent at least one of cutting elements 22 and may extend generally between forward end 30 of bit body 20 and side opening 38.

The position and orientation of cutting elements 22 may facilitate drilling of a borehole as drill bit 12 is rotated during drilling of a subterranean formation. For example, cutting elements 22 may be positioned on drill bit 12 so that portions of cutting elements 22 (e.g., chamfer 72 illustrated in FIG. 4) extend axially forward from bit body 20 and/or radially beyond peripheral side surface 41 of bit body 20 relative to central axis 18. Accordingly, significant portions of cutting elements 22 may contact a subterranean formation during drilling.

Figure 3A:
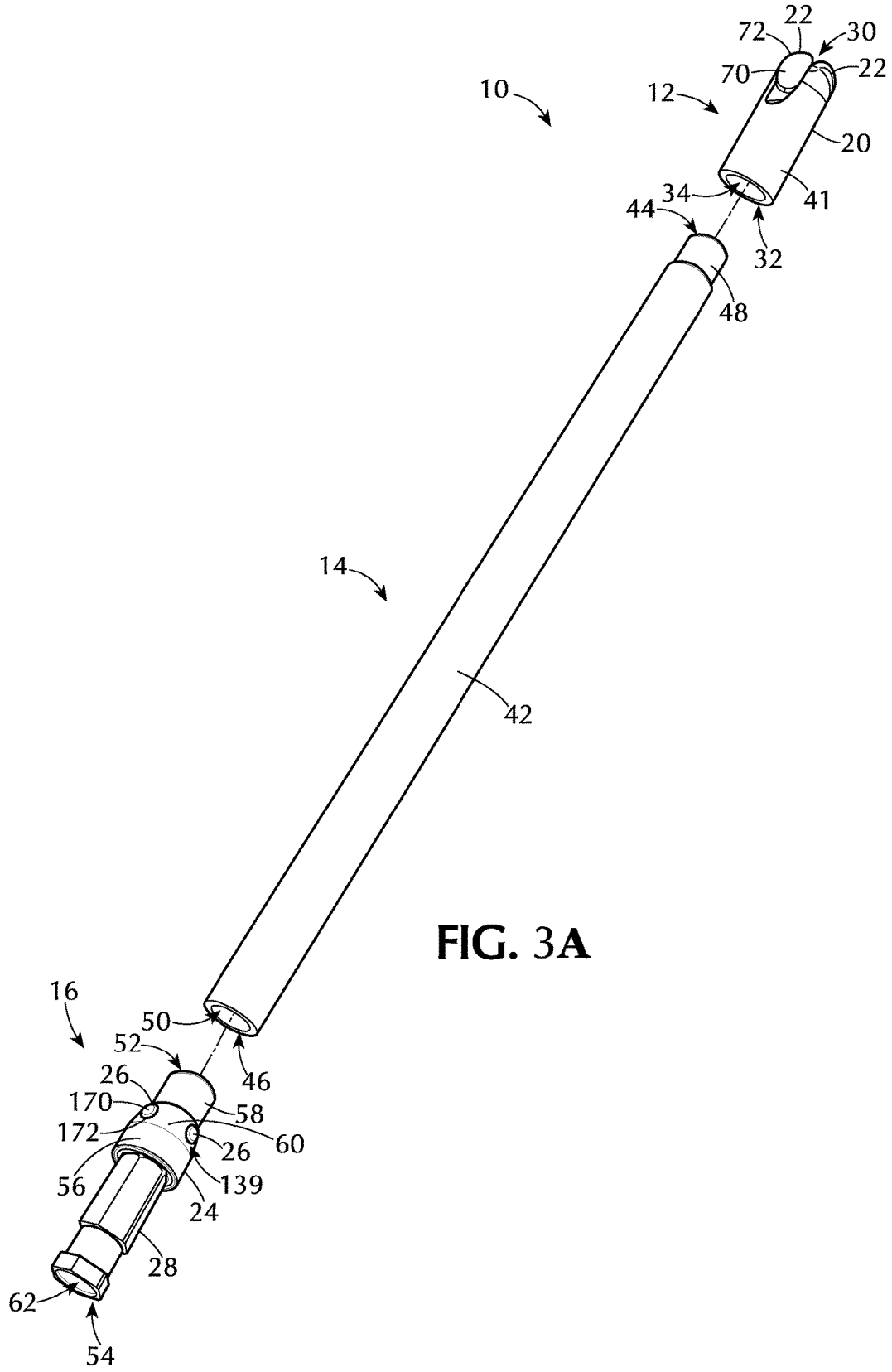
FIG. 3A is an exploded view of an exemplary drilling assembly according to at least one embodiment.
Figure 3B:
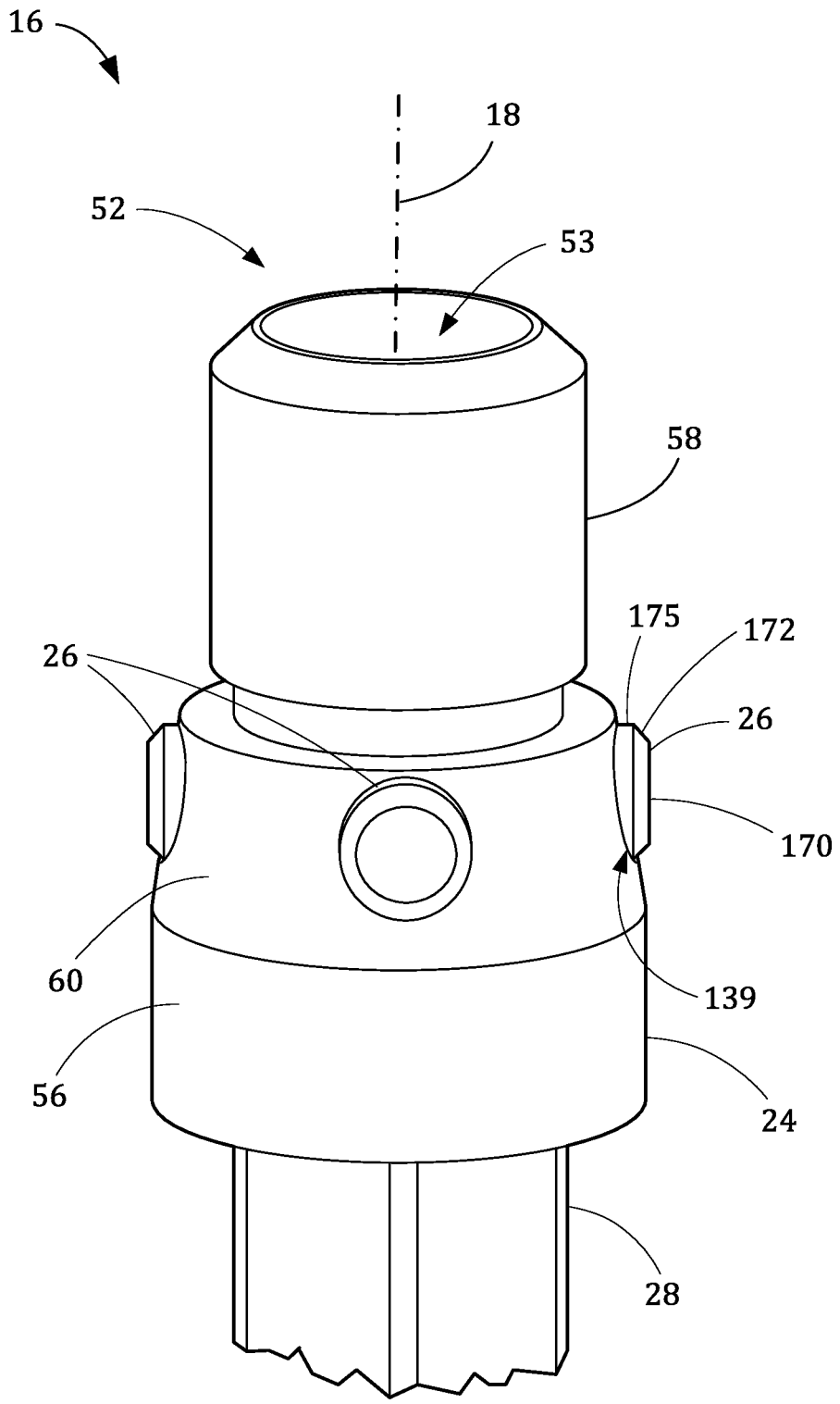
FIG. 3B is a cut-away perspective view of an exemplary reamer member according to at least one embodiment.

FIG. 3A is an exploded view of an exemplary drilling assembly 10 according to at least one embodiment and FIG. 3B is a cut-away perspective view of an exemplary reamer member of exemplary drilling assembly 10. Drill bit 12 of drilling assembly 10 may comprise any type of drill bit suitable for drilling in wet-drilling environments and/or dry-drilling environments, without limitation (see, e.g., drill bit 12 illustrated in FIG. 2). As shown in FIG. 3, spacer 14 may be coupled to a rearward end of drill bit 12. Spacer 14 may extend axially rearward from drill bit 12 along central axis 18.

Spacer 14 may comprise a substantially elongated and/or cylindrical shaft having a forward end 44 and a rearward end 46. Spacer 14 may also comprise any other suitable shape, without limitation. Spacer 14 may be configured to be temporarily or permanently coupled to drill bit 12 (e.g., by threaded connection, pin connection, mechanical attachment, brazing, welding, bonding, interference fit, and/or other suitable coupling). According to at least one embodiment, spacer 14 may include coupling surfaces corresponding to surfaces defined within drill bit 12. For example, spacer 14 may comprise a forward coupling projection 48 configured to fit within rearward opening 34 of drill bit 12. In some embodiments, forward coupling projection 48 may comprise a rounded, hexagonal, and/or threaded periphery corresponding to a rounded, hexagonal, and/or threaded interior surface defined within drill bit 12. In some embodiments, forward coupling projection 48 may comprise a pin connector corresponding to a pin hole and/or a recess defined within drill bit 20.

Spacer 14 may have a maximum diameter that is less than or approximately the same as a maximum diameter of drill bit 12. For example, a peripheral side surface 42 of spacer 14 may not extend radially beyond an outer peripheral portion of drill bit 12 relative to central axis 18. According to at least one embodiment, peripheral side surface 42 of spacer 14 may have substantially the same diameter as peripheral side surface 41 of bit body 20. In various embodiments, spacer 14 may have a length in the axial direction of central axis 18 that is longer than the length of drill bit 12 in the axial direction.

According to some embodiments, spacer 14 may comprise a hollow member configured to convey material toward and/or away from drill bit 12. For example, an internal passage may be defined in spacer 14 so as to extend from rearward opening 50 defined in rearward end 46 of spacer 14 to an opening defined in forward end 44 of spacer 14. Such a passage may be configured to convey a fluid, such as drilling fluid and/or air, through spacer 14 and toward drill bit 12. A passage defined within spacer 14 may also be configured to convey cutting debris, such as rock and/or carbonaceous debris, away from drill bit 12.

Reamer member 16 may be coupled to rearward end 46 of spacer 14 such that reamer member 16 is axially spaced away from drill bit 12. Reamer member 16 may be centered about central axis 18. Reamer member 16 may include a reamer body 24 and at least one cutting element 26 coupled to reamer body 24. In some embodiments, reamer member 16 may also include a rearward coupling portion 28, such as a shank, extending along central axis 18.

Reamer member 16 may have a forward end 52 and a rearward end 54 and may comprise any suitable shape, without limitation. Reamer member 16 may be configured to be temporarily or permanently coupled to drill bit 12 (e.g., by threaded connection, pin connection, mechanical attachment, brazing, welding, bonding, interference fit, and/or other suitable coupling). According to at least one embodiment, reamer member 16 may include coupling surfaces corresponding to surfaces defined within spacer 14. For example, reamer member 16 may comprise a forward coupling projection 58 configured to fit within rearward opening 50 of spacer 14. In some embodiments, forward coupling projection 58 may comprise a rounded, hexagonal, and/or threaded periphery corresponding to a rounded, hexagonal, and/or threaded interior surface defined within spacer 14. In some examples, forward coupling projection 58 may comprise a pin connector corresponding to a pin hole and/or a recess defined near rearward end 46 of spacer 14.

According to at least one embodiment, as shown in FIG. 3, a plurality of cutting elements 26 may be coupled to reamer body 24 of reamer member 16. For example, cutting elements 26 may be mounted to a mounting region 60 of reamer member 16. As shown in FIG. 3, mounting region 60 may include a surface of reamer member 16 sloping between forward coupling projection 58 and peripheral side surface 56. In some embodiments, mounting region 60 may include recessed portions, such as cutter pockets 139, that are shaped and configured to hold corresponding cutting elements 26. Cutting elements 26 may be coupled to reamer body 24 using any suitable technique, including, for example, mechanical attachment, brazing or welding. According to some examples, a back surface of each cutting element 26 (e.g., back surface 174 illustrated in FIG. 5) may be mounted and secured to a corresponding mounting surface of reamer body 24.

Each cutting element 26 may comprise a cutting face 170 and a peripheral surface 175. Cutting face 170 and peripheral surface 175 may each be formed in any suitable shape and arranged in any suitable configuration, without limitation. Cutting elements 26 may be positioned on reamer member 16 in any suitable orientation, without limitation. For example, as illustrated in FIG. 3, cutting elements 26 may be coupled to reamer body 24 so that cutting faces 170 of cutting elements 26 face away from reamer body 24 and chamfer surfaces 172 are exposed adjacent cutting faces 170. In at least one embodiment, cutting faces 170 of cutting elements 26 may face radially outward from central axis 18.

Reamer member 16 may have a maximum diameter that is greater than a maximum diameter of drill bit 12. For example, portions of cutting elements 26 may extend radially beyond an outer peripheral portion of drill bit 12, including cutting edges of cutting elements 22, relative to central axis 18. According to at least one embodiment, a maximum diameter of reamer member 16 may exceed a maximum diameter of drill bit 12 by less than approximately 1 mm with respect to central axis 18. According to additional embodiments, a maximum diameter of reamer member 16 may exceed a maximum diameter of drill bit 12 by approximately 1 mm or more with respect to central axis 18. According to various embodiments, a maximum diameter of reamer member 16 may exceed a maximum diameter of drill bit 12 by between approximately 1 mm and approximately 2 mm, between approximately 2 mm and approximately 3 mm, between approximately 3 mm and approximately 4 mm, between approximately 4 mm and approximately 5 mm, or any other suitable amount, without limitation. By way of example, drill bit 12 may extend to a maximum diameter of approximately 22 mm with respect to central axis 18, and reamer member 16 may extend to a maximum diameter of approximately 24 mm with respect to central axis 18.

The position and orientation of cutting elements 26 may facilitate widening of a borehole as drilling assembly 10 is rotated during drilling. By way of example, cutting elements 26 may be positioned on reamer member 16 so that portions of each cutting element 26, such as chamfer 172, extend radially beyond peripheral side surface 56 of reamer member 16 relative to central axis 18. Accordingly, cutting elements 26 may contact a subterranean formation during drilling. Because cutting elements 26 extend radially beyond an outer peripheral portion of drill bit 12 relative to central axis 18, reamer member 16 may widen a portion of a borehole initially drilled by drill bit 12, as will be described in greater detail with reference to FIG. 6.

According to some embodiments, reamer member 16 may comprise a hollow member configured to convey material toward and/or away from drill bit 12. For example, an internal passage may be defined in spacer 14 so as to extend from rearward opening 62 defined in rearward end 54 of reamer member 16 to a forward opening 53 defined in forward end 52 of reamer member 16. Such a passage may be configured to convey a fluid, such as drilling fluid and/or air, through reamer member 16 and toward spacer 14 and drill bit 12. A passage defined within reamer member 16 might also be configured to convey cutting debris, such as rock and/or carbonaceous debris, away from drill bit 12.

In various embodiments, rearward coupling portion 28 of reamer member 16 may comprise any shape suitable for coupling with and/or being driven rotationally about longitudinal axis 18 by a rotational member, such as a rotational drill chuck. For example, a cross-section of rearward coupling portion 28 may comprise an outer periphery having any suitable coupling and/or engagement shape, such as, for example, a generally geometric-shaped outer periphery, a generally polygonal-shaped outer periphery (e.g., a hexagonal or square shape), an uneven-shaped outer periphery, and/or a non-circular outer periphery, without limitation. In various embodiments, an exterior of rearward coupling portion 28 may comprise a threaded outer peripheral surface configured to be coupled with a drill chuck having a corresponding threaded inner surface.

Drill bit 12 and spacer 14 may have a combined length $L_1$ in the axial direction along central axis 18 that is configured to form a narrow borehole portion during drilling for accommodating a portion of a subterranean support-bolt, such as a threaded portion of a support-bolt. According to at least one embodiment, drill bit 12 and the spacer 14 may have a combined length $L_1$ of less than approximately 12 inches in the axial direction. According to additional embodiments, drill bit 12 and the spacer 14 may have a combined length $L_1$ of approximately 12 or more in the axial direction. According to various embodiments, drill bit 12 and the spacer 14 may have a combined length $L_1$ in the axial direction of between approximately 12 inches and approximately 13 inches, between approximately 13 inches and approximately 14 inches, between approximately 14 inches and approximately 15 inches, between approximately 15 inches and approximately 16 inches, between approximately 16 inches and approximately 17 inches, between approximately 17 inches and approximately 18 inches, between approximately 18 inches and approximately 19 inches, between approximately 19 inches and approximately 20 inches, or any other suitable length, without limitation.

Figure 4:
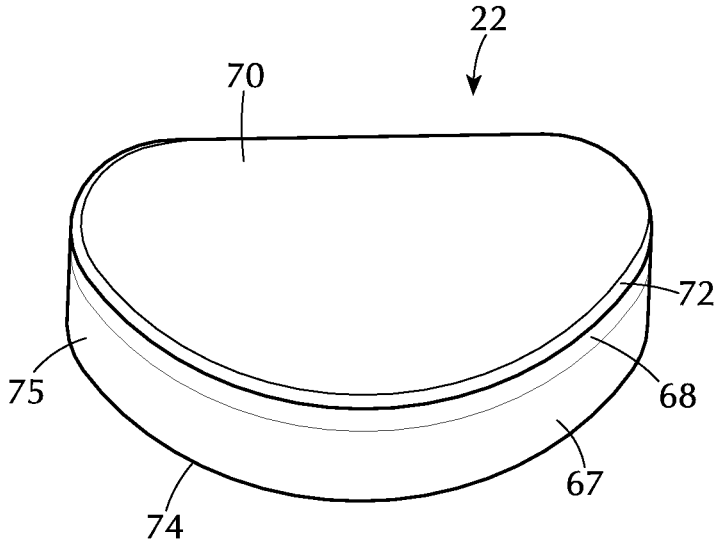
FIG. 4 is a perspective view of an exemplary cutting element according to at least one embodiment.
Figure 5:
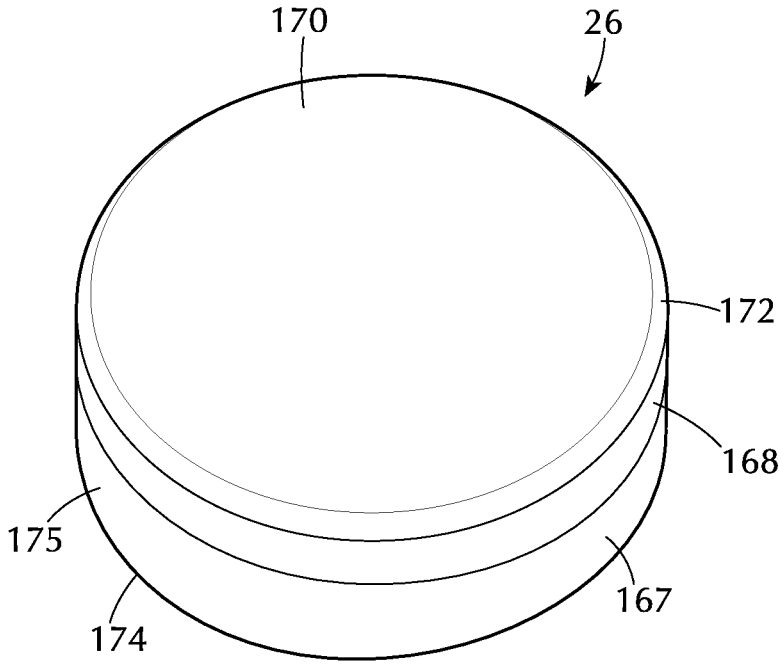
FIG. 5 is a perspective view of an exemplary cutting element according to at least one embodiment.

FIGS. 4 and 5 are perspective views of exemplary cutting elements that may be coupled to a drilling assembly and/or drill bit, such as exemplary drilling assembly 10 and/or drill bit 12 shown in FIGS. 1-3. As illustrated in FIG. 4, cutting element 22 may comprise a layer or table 68 affixed to or formed upon a substrate 67. Table 68 may be formed of any material or combination of materials suitable for cutting subterranean formations, including, for example, a superhard or superabrasive material such as polycrystalline diamond (PCD). The word "superhard," as used herein, may refer to any material having a hardness that is at least equal to a hardness of tungsten carbide. Similarly, substrate 67 may comprise any material or combination of materials capable of adequately supporting a superabrasive material during drilling of a subterranean formation, including, for example, cemented tungsten carbide.

For example, cutting element 22 may comprise a superhard PCD table 68 comprising polycrystalline diamond bonded to a substrate 67 comprising cobalt-cemented tungsten carbide. In at least one embodiment, after forming PCD table 68, a catalyst material (e.g., cobalt or nickel) may be at least partially removed from PCD table 68. A catalyst material may be removed from at least a portion of PCD table 68 using any suitable technique, such as, for example, acid leaching. In some examples, PCD table 68 may be exposed to a leaching solution until a catalyst material is substantially removed from PCD table 68 to a desired depth relative to one or more surfaces of PCD table 68.

According to some embodiments, the PCD table 68 may be fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles, infiltrated from a metal-solvent catalyst foil or powder adjacent to the diamond particles, infiltrated from a metal-solvent catalyst present in a cemented carbide substrate, or combinations of the foregoing. The bonded diamond grains (e.g., $sp^3$-bonded diamond grains), so-formed by HPHT sintering the diamond particles, define interstitial regions with the metal-solvent catalyst disposed within the interstitial regions. The diamond particles may exhibit a selected diamond particle size distribution.

The as-sintered PCD body may be leached by immersion in an acid, such as aqua regia, nitric acid, hydrofluoric acid, or subjected to another suitable process to remove at least a portion of the metal-solvent catalyst from the interstitial regions of the PCD body and form the PCD table 68. For example, the as-sintered PCD body may be immersed in the acid for about 2 to about 7 days (e.g., about 3, 5, or 7 days) or for a few weeks (e.g., about 4 weeks) depending on the process employed. Even after leaching, a residual, detectable amount of the metal-solvent catalyst may be present in the at least partially leached PCD table 68. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may be at least partially removed by the selected leaching process or may be relatively unaffected by the selected leaching process.

The plurality of diamond particles used to form the PCD table 68 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes) without limitation.

In at least one embodiment, substrate 67 may be at least partially covered with a protective layer, such as, for example, a polymer cup, to prevent corrosion of substrate 67 during leaching. In additional embodiments, table 68 may be separated from substrate 67 prior to leaching table 68. For example, table 68 may be removed from substrate 67 and placed in a leaching solution so that all or selected surfaces of table 68 are at least partially leached. In various examples, table 68 may be reattached to substrate 67 or attached to a new substrate 67 following leaching. Table 68 may be attached to substrate 67 using any suitable technique, such as, for example, mechanical attachment, brazing, welding, or HPHT processing.

As shown in FIG. 4, cutting element 22 may also comprise a cutting face 70 formed by table 68, a peripheral surface 75 formed by table 68 and substrate 67, and a back surface 74 formed by substrate 67. Cutting face 70, peripheral surface 75, and back surface 74 may each be formed in any suitable shape and may be arranged in any suitable configuration, without limitation. According to various embodiments, cutting face 70 may be substantially planar and peripheral surface 75 may be substantially perpendicular to cutting face 70. Back surface 74 may be opposite and, in some embodiments, substantially parallel to cutting face 70.

In at least one embodiment, cutting face 70 may have a partially arcuate periphery. In another embodiment, cutting face 70 may have a substantially semi-circular periphery. For example, two cutting elements 22 may be cut from a single substantially circular cutting element blank, resulting in two substantially semi-circular cutting elements 22. In some embodiments, angular portions of peripheral surface 75 may be rounded to form a substantially arcuate surface around cutting element 22.

As illustrated in FIG. 4, cutting element 22 may also comprise a chamfer 72 formed along at least a portion of a periphery of table 68 between cutting face 70 and peripheral surface 75. The phrase "cutting edge" may refer, without limitation, to a sharp, rounded, and/or sloped edge portion of cutting element 22 that is configured to be exposed to and/or in contact with a formation during drilling. In some embodiments, and as illustrated FIG. 2, a cutting edge may include a chamfer 72 (i.e., sloped or angled). A cutting edge may also include any other suitable surface shape between cutting face 70 and peripheral surface 75, including, without limitation, an arcuate surface (e.g., a radius), a sharp edge, multiple chamfers/radii, a honed edge, and/or combinations of the foregoing. A cutting edge may be configured to contact and/or cut a subterranean formation as drill bit 12 is rotated relative to a subterranean formation (as will be described in greater detail below in connection with FIG. 6).

FIG. 5 is a perspective view of an exemplary cutting element 26 according to at least one embodiment. As illustrated in FIG. 5, cutting element 26 may comprise a table 168 affixed to or formed upon a substrate 167. Table 168 may be formed of any material or combination of materials suitable for cutting subterranean formations, including, for example, a superhard or superabrasive material such as polycrystalline diamond (PCD). Similarly, substrate 167 may comprise any material or combination of materials capable of adequately supporting a superabrasive material during drilling of a subterranean formation, including, for example, cemented tungsten carbide. Cutting element 26 may also comprise a cutting face 170 formed by table 168, a peripheral surface 175 formed by table 168 and substrate 167, and a back surface 174 formed by substrate 167. Cutting face 170, peripheral surface 175, and back surface 174 may each be formed in any suitable shape and arranged in any suitable configuration, without limitation. In some embodiments, as illustrated in FIG. 5, peripheral surface 175 may comprise a substantially cylindrical surface.

In at least one embodiment, cutting face 170 may have a substantially arcuate periphery. In another embodiment, cutting face 170 may have a substantially circular periphery. Cutting element 26 may also comprise a cutting edge having a chamfer 172 formed along at least a portion of a periphery of table 168 between cutting face 170 and peripheral surface 175. According to some embodiments, chamfer 172 may be formed along substantially the entire periphery of table 168. Table 168 may also include any other suitable surface shape between cutting face 170 and peripheral surface 175, including, without limitation, an arcuate surface, a sharp edge, and/or a honed edge. Such a cutting edge may be configured to contact and/or cut a subterranean formation as drilling assembly 10 is rotated relative to a subterranean formation (as will be described in greater detail in connection with FIG. 6).

Figure 6:
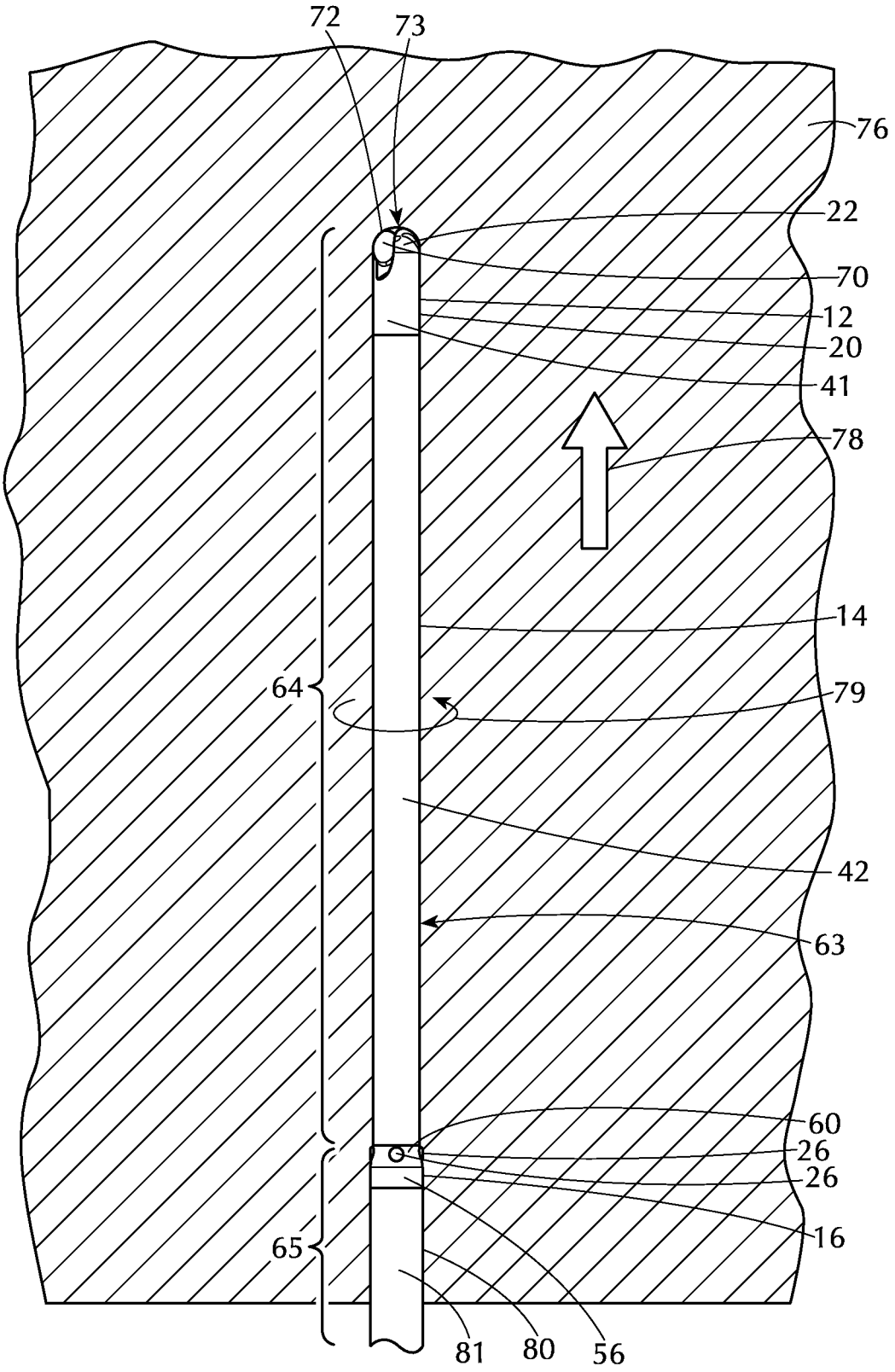
FIG. 6 is a partial cross-sectional side view of an exemplary drilling assembly as it is rotated relative to a formation.

FIG. 6 is a partial cross-sectional side view of an exemplary drilling assembly 10 during drilling of a borehole 63 in a formation 76. As illustrated in FIG. 6, drilling assembly 10 may be coupled to a drilling attachment 80 (e.g., a bit seat, a reamer, a drill steel, and/or other suitable drilling attachment). Drilling attachment 80 may comprise any suitable type of drill rod or drill string configured to couple drilling assembly 10 to a drilling apparatus. Drilling attachment 80 may comprise any suitable shape, without limitation. In some embodiments, drilling attachment 80 may comprise a substantially elongated and/or cylindrical shaft. According to at least one embodiment, force may be applied by a drilling apparatus to drilling assembly 10 via drilling attachment 80, causing drilling assembly 10 to be forced against formation 76 in both a forward direction 78 and a rotational direction 79. As force is applied to drilling assembly 10 in rotational direction 79, drilling assembly 10 may be rotated relative to formation 76 in rotational direction 79. As illustrated in FIG. 6, cutting faces 70 on cutting elements 22 may face generally in rotational direction 79 and may be angled with respect to rotational direction 79.

The position and orientation of cutting elements 22 of drill bit 12 and cutting elements 26 of reamer member 16 may facilitate drilling of borehole 63 in formation 76 as drilling assembly 10 is rotated within borehole 63. As drilling assembly 10 is forced against formation 76 and rotated relative to formation 76, debris, such as cuttings, may be removed from formation 76, thereby lengthening and/or widening borehole 63. Cuttings may comprise pulverized material, fractured material, sheared material, a continuous chip, and/or any other form of cutting, without limitation. Accordingly to at least one embodiment, drill bit 12 may function as a non-coring drill bit, with cutting elements 22 being sized and positioned on drill bit 12 so as to prevent a core of subterranean formation material from being formed at a forward end 73 of borehole 63. For example, cutting elements 22 may be positioned on drill bit 12 so as to form a generally apical cutting tip that cuts borehole 63 without forming a central core within a distal end of borehole 63 during drilling.

As illustrated in FIG. 6, drilling assembly 10 may be configured to form a borehole having at least two different diameters. For example, borehole 63 may comprise a forward borehole portion 64 formed to a first diameter by drill bit 12. Borehole 63 may further comprise an expanded borehole portion 65 having a diameter that is greater than the diameter of forward borehole portion 64. Expanded borehole portion 65 may be formed to the greater diameter by reamer member 16. Forward borehole portion 64 and expanded borehole portion 65 may each be formed to any suitable length, without limitation. According to some embodiments, drilling assembly 10 may be configured to form borehole 63 so as to securely accommodate and hold a subterranean support bolt, such as a roof bolt and/or a face bolt. In at least one embodiment, drilling assembly 10 may be configured to form borehole 63 to accommodate a support-bolt having a threaded portion. For example, drilling assembly 10 may form a borehole configured to accommodate a lag bolt or rock screw having a threaded portion along only part of the length of the support bolt, such as a portion of the lag bolt spaced apart from the head of the lag bolt.

Drilling assembly 10 may be configured to form forward borehole portion 64 of borehole 63 to be sized such that a threaded portion of a subterranean support-bolt may be securely attached or bonded into (e.g., by epoxy, brazing, press-fit, or as otherwise known in the art) and held within borehole portion 64. Accordingly, drill bit 12 and spacer 14 of drilling assembly 10 may have a combined length configured to form forward borehole portion 64 to have a length that securely accommodates a threaded portion of a support bolt. Reamer member 16 may be configured to widen expanded borehole portion 65 of borehole 63 so as to accommodate a portion of a subterranean support-bolt that is between a threaded portion and a head of the subterranean support-bolt. Expanded borehole portion 65 of borehole 63 may have a diameter that enables a threaded portion of a subterranean support bolt to be inserted into borehole 63 without the necessity of driving the threaded portion the entire length of borehole 63.

For example, an operator may insert the threaded portion of a subterranean support bolt, such as a lag bolt or other threaded support bolt, axially through the length of expanded borehole portion 65 of borehole 63, without the necessity of screwing the threaded portion of support bolt the into the formation material defining expanded borehole portion 65. The subterranean support bolt may subsequently be driven into the formation material defining forward borehole portion 64 of borehole 63, which has a smaller diameter than expanded borehole portion 65. Accordingly, a significant amount of energy and time may be conserved, since it is not necessary to screw the threaded portion of a support bolt through rock material over the entire length of borehole 63. Moreover, expanded borehole portion 65 of borehole 63 may be widened so as to accommodate a portion of a support bolt, such as a lag bolt, that is wider than a threaded portion of the support bolt. Additionally, drilling assembly 10 may enable a borehole having at least two separate diameters, such as borehole 63, to be formed without the necessity of using at least two separate drill bits having different diameters. Accordingly, a borehole having at least two separate diameters may be formed during a single drilling operation using drilling assembly 10, as opposed to being formed over the course of two or more drilling operations using two or more separate drill bits having different diameters.

Figure 7:
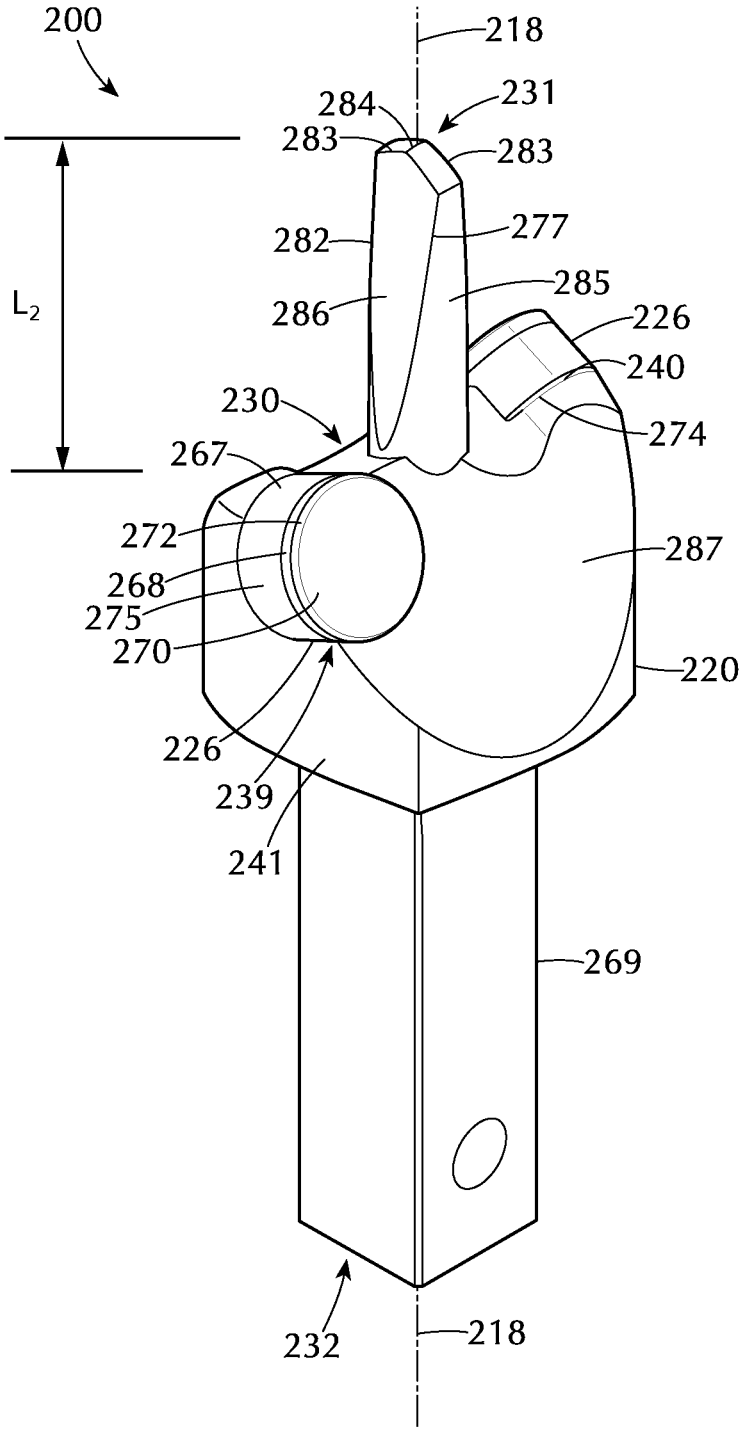
FIG. 7 is a perspective view of an exemplary drill bit according to at least one embodiment.

FIG. 7 shows a perspective view of an exemplary support-bolt drill bit 200 according to at least one embodiment. Drill bit 200 may represent any type or form of earth-boring or drilling tool, including, for example, a rotary borehole drill bit. In contrast to a coring drill bit that forms a central core of material being drilled during operation, drill bit 200 may be non-coring drill bit. For example, cutting elements 226 and a central pilot 282 of drill bit 200 may cut a concave borehole without forming a central core within a distal end of a borehole during drilling.

As illustrated in FIG. 7, drill bit 200 may comprise a bit body 220 having a forward end 230 and a rearward end 232. At least one cutting element 226 may be coupled to bit body 220. For example, as shown in FIG. 7, drill bit 200 may comprise two cutting elements 226 mounted to bit body 220. Bit body 220 may comprise a rearward coupling portion 269, such as a coupling shank, having any configuration suitable for coupling with another attachment (see, e.g., drilling attachment 281 illustrated in FIGS. 8 and 9). A peripheral side surface 241 may define an outer periphery of bit body 220. In some embodiments, peripheral side surface 241 may be located radially outward from an outer surface of rearward coupling portion 269. As illustrated in FIG. 7, drill bit 200 may be centered around and/or may be rotatable about a central axis 218. Central axis 218 may extend in a lengthwise direction through drill bit 200 between forward end 230 and rearward end 232. In at least one example, drill bit 200 may comprise two cutting elements 226 that are positioned approximately 180° apart from each other relative to central axis 218.

Bit body 220 may also comprise at least one cutter pocket 239 for securing a cutting element 226 to bit body 220. Cutter pockets 239 may each include at least one mounting surface, such as back mounting surface 240. Cutting elements 226 may be mounted to bit body 220 so that portions of cutting elements 226 abut cutter pockets 239. Cutting elements 226 may each comprise a layer or table 268 affixed to or formed upon a substrate 267. Table 268 may be formed of any material or combination of materials suitable for cutting subterranean formations, including, for example, a superhard or superabrasive material such as polycrystalline diamond (PCD). Similarly, substrate 267 may comprise any material or combination of materials capable of adequately supporting a superabrasive material during drilling of a subterranean formation, including, for example, cemented tungsten carbide. For example, cutting element 226 may comprise a table 268 comprising polycrystalline diamond bonded to a substrate 267 comprising cobalt-cemented tungsten carbide. In at least one embodiment, after forming table 268, a catalyst material (e.g., cobalt or nickel) may be at least partially removed from table 268 using any suitable technique, such as, for example, acid leaching.

Cutting elements 226 may each comprise a cutting face 270 formed by table 268, a peripheral surface 275 formed by table 268 and substrate 267, and a back surface 274 formed by substrate 267. According to various embodiments, cutting face 270 may be substantially planar and peripheral surface 275 may be substantially perpendicular to cutting face 270. Back surface 274 may be spaced away from and, in some embodiments, substantially parallel to cutting face 270. Back surfaces 274 of cutting elements 226 may be mounted and secured to back mounting surfaces 240 of cutter pockets 239, as shown in FIG. 7. Cutting face 270 and peripheral surface 275 may be formed in any suitable shape, without limitation. In one embodiment, cutting face 270 may have a substantially arcuate periphery. In another embodiment, cutting face 270 may have a substantially circular periphery.

As illustrated in FIG. 7, each cutting element 226 may also comprise a cutting edge having a chamfer 272, formed along at least a portion of a periphery of table 268 between cutting face 270 and peripheral surface 275. The cutting edge may also include any other suitable surface shape between cutting face 270 and peripheral surface 275, including, without limitation, an arcuate surface (e.g., a radius), a sharp edge, multiple chamfers/radii, a honed edge, and/or combinations of the foregoing. Chamfer 272 may be configured to contact and/or cut a subterranean formation as drill bit 200 is rotated relative to the formation.

Bit body 220 may also comprise at least one inward sloping surface 287. Inward sloping surfaces 287 may guide debris away from a forward portion of drill bit 200. Additionally, inward sloping surfaces 287 may enable a clearance to be provided between bit body 220 and a subterranean formation during drilling. Inward sloping surfaces 287 may be defined radially inward from peripheral side surface 241. According to some embodiments, bit body 220 may also comprise at least one opening, such as a fluid port or vacuum opening, for conveying fluid and/or or material toward or away from a forward portion of drill bit 200. For example, in a wet drilling environment, drilling fluid may be directed through an opening in bit body 220 toward a forward portion of drill bit 200. In additional embodiments, debris, such as rock cuttings, may be conveyed away from drill bit 200 through an internal passage, such as a vacuum hole. Drilling fluids and cutting debris may also be conveyed away from drill bit 200 via channels formed in an exterior of bit body 220 and/or an exterior of a drill steel coupled to drill bit 200.

According to various embodiments, drill bit 200 may comprise a central pilot 282 extending from bit body 220 in an axially forward direction. For example, as illustrated in FIG. 7, central pilot 282 may extend along central axis 218 in an axially forward direction between bit body 220 and a projection forward end 231. Projection forward end 231 may extend axially beyond cutting elements 226 in the axially forward direction along central axis 218. According to at least one embodiment, central pilot 282 may have a length L2 of less than approximately 0.5 inches in the axial direction. According to additional embodiments, central pilot 282 may have a length L2 of approximately 0.5 inches or more in the axial direction. According to various embodiments, central pilot 282 may have a length L2 of between approximately 0.5 inches and approximately 1.0 inches, greater than approximately 1.0 inches, between approximately 1.0 inches and approximately 1.5 inches, between approximately 1.5 inches and approximately 2.0 inches, greater than approximately 2.0 inches, between approximately 2.0 inches and approximately 2.5 inches, between approximately 2.5 inches and approximately 3.0 inches, greater than approximately 3.0 inches, between approximately 3.0 inches and approximately 3.5 inches, between approximately 3.5 inches and approximately 4.0 inches, greater than approximately 4.0 inches, between approximately 4.0 inches and approximately 4.5 inches, between approximately 4.5 inches and approximately 5.0 inches, greater than approximately 5.0 inches, or any other suitable length, without limitation.

It is currently believed that having a central pilot with a length of greater than 1, greater than 2, or greater than 3 inches can protect the axially trailing cutting elements. In one embodiment, the central pilot comprises cobalt-cemented tungsten carbide or any other non-diamond material (e.g., a metal) and the axially trailing cutting elements comprise polycrystalline diamond or any other polycrystalline superhard material.

Central pilot 282 may comprise any suitable material or combination of materials, including, for example, hard and/or superhard materials, such as cemented tungsten carbide, polycrystalline diamond, and/or steel, without limitation. According to at least one embodiment, central pilot 282 may be integrally formed with bit body 220. In some embodiments, central pilot 282 may comprise a separate member that is coupled to bit body 220, as will be discussed in greater detail below with reference to FIGS. 10 and 11.

As shown in FIG. 7, cutting elements 226 of drill bit 200 may extend radially beyond central pilot 282 relative to central axis 218. For example, cutting edges of cutting elements 226 may extend from axially forward of bit body 220 to radially beyond central pilot 282 relative to central axis 218. In some embodiments, central pilot 282 may have a diameter that is less than a diameter of peripheral surface 241 of bit body 220.

Central pilot 282 may comprise any suitable shape and/or configuration, without limitation. According to some embodiments, central pilot 282 may have at least one cutting edge configured to cut away material from a formation, such as rock material, carbonaceous material, and/or other subterranean material, during drilling. For example, as illustrated in FIG. 7, central pilot 282 may comprise a projection tip 284, which is disposed distally from bit body 220 at projection forward end 231. Projection tip 284 of central pilot 282 may comprise a substantially apical cutting tip centered about central axis 218. Central pilot 282 may also comprise at least one forward projection cutting edge 283. According to at least one embodiment, forward projection cutting edges 283 may be located at and/or adjacent projection forward end 231 of central pilot 282. Additionally, central pilot 282 may have a peripheral side surface 285 extending at least partially between bit body 220 and projection forward end 231. In some embodiments, peripheral side surface 285 may comprise an arcuate surface portion of central pilot 282.

Central pilot 282 may also comprise at least one projection face 286 located radially inward of peripheral side surface 285. According to at least one embodiment, a forward projection cutting edge 283 may be located at a forward portion of each projection face 286. A projection face edge 277 may also be located on a periphery of projection face 286. For example, projection face edge 277 may be located at an intersection of projection face 286 and peripheral side surface 285. According to some embodiments, projection face edge 277 may act as a cutting edge during drilling. Forward projection cutting edges 283 and/or projection face peripheral edges 277 may comprise any suitable edge shape, including, without limitation, a sharp edge, a chamfered edge, an arcuate surface (e.g., a radius), multiple chamfers/radii, a honed edge, and/or combinations of the foregoing. Forward projection cutting edges 283 and/or projection face peripheral edges 277 may be configured to contact and/or cut a subterranean formation as drill bit 200 is rotated relative to a subterranean formation.

Figure 8:
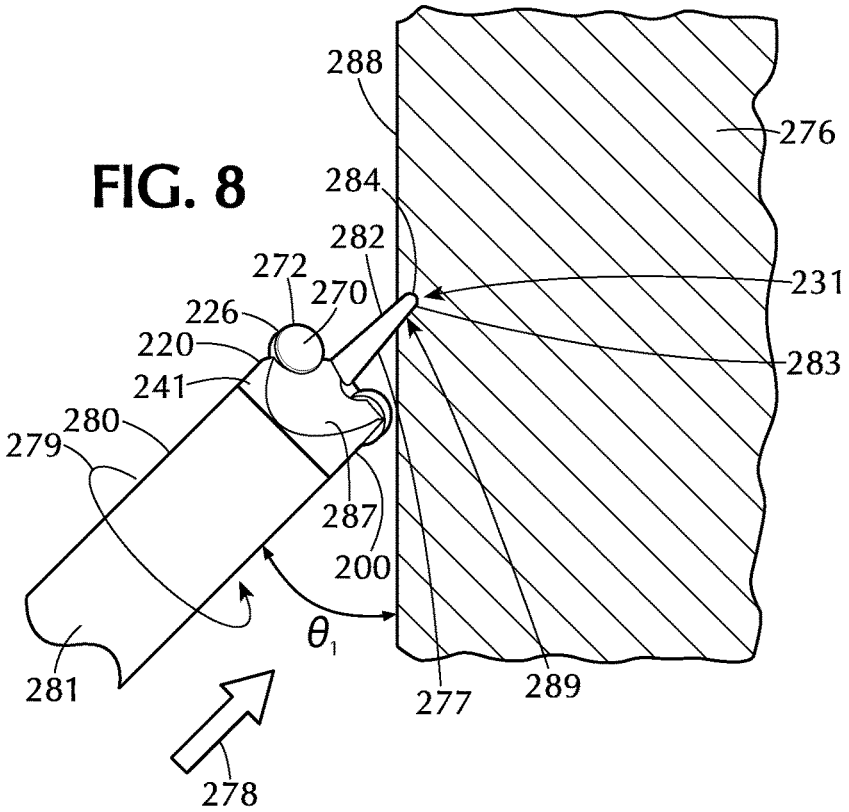
FIG. 8 is a partial cross-sectional side view of an exemplary drilling assembly as it is rotated relative to a formation.
Figure 9:
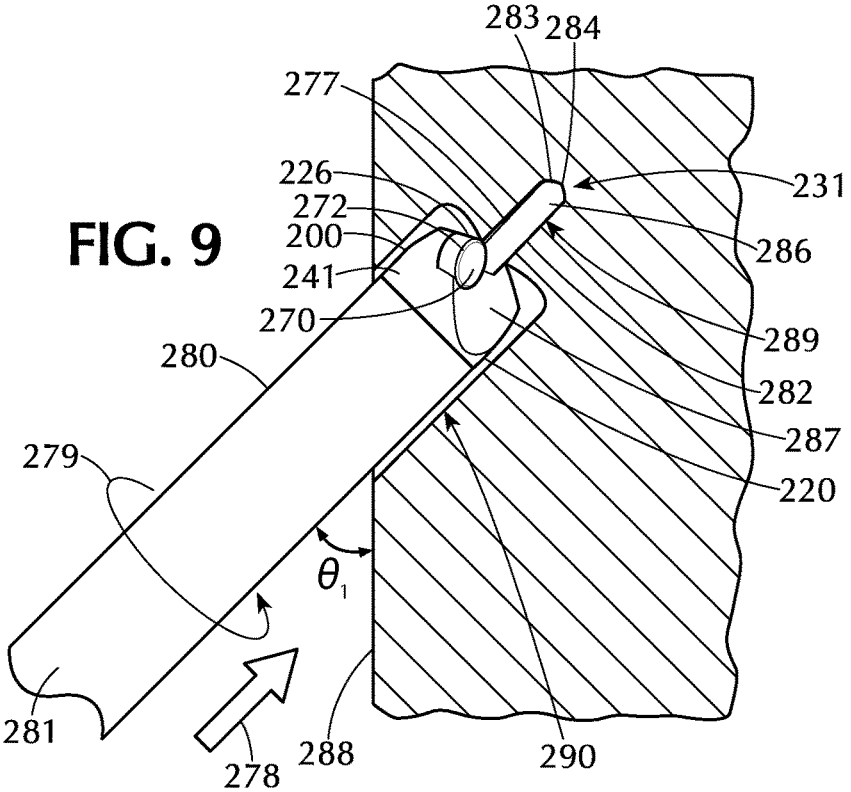
FIG. 9 is a partial cross-sectional side view of an exemplary drilling assembly as it is rotated relative to a formation.

FIGS. 8 and 9 show partial cross-sectional side views of an exemplary drilling assembly comprising support-bolt drill bit 200 coupled to a drilling attachment 280 and rotated relative to a subterranean formation 276. As illustrated in FIGS. 8 and 9, drill bit 200 may be coupled to a drilling attachment 280 (e.g., a bit seat, a reamer, a drill steel, and/or other suitable drilling attachment). Drilling attachment 280 may comprise any suitable type of drill rod or drill string configured to couple drill bit 200 to a drilling apparatus. Drilling attachment 280 may comprise any suitable shape, without limitation. In some embodiments, drilling attachment 280 may comprise a substantially elongated and/or cylindrical shaft. According to at least one embodiment, force may be applied by a drilling apparatus to drill bit 200 via drilling attachment 280, causing drill bit 200 to be forced against formation 276 in both a forward direction 278 and a rotational direction 279. As force is applied to drill bit 200 in rotational direction 279, drill bit 200 may be rotated relative to formation 276 in rotational direction 279. As illustrated in FIGS. 8 and 9, cutting faces 270 on cutting elements 226 may face generally in rotational direction 279 and may be angled with respect to rotational direction 279.

As shown in FIG. 8, central pilot 282 may contact formation 276 prior to bit body 220 and cutting elements 226, even when drill bit 200 is oriented at a non-perpendicular angle relative to a surface 288 of formation 276. Accordingly, as drill bit 200 is forced against formation 276 in both a forward direction 278 and a rotational direction 279 during drilling, central pilot 282 may cut into formation 276 to form a pilot hole 289. Central pilot 282 may have a length such that, when central pilot 282 is placed in contact with surface 288 of formation 276, cutting elements 226 of drill bit 200 do not contact the formation. Accordingly, central pilot 282 may begin drilling of pilot hole 289 without cutting elements 226 contacting formation 276.

Projection tip 284 of central pilot 282 may have a substantially apical shape centered about central axis 218 and a smaller diameter than a portion of drill bit 200 that includes bit body 220 and cutting elements 226. Accordingly, central pilot 282 may facilitate an efficient and controlled entry of drill bit 200 into formation 276, while preventing skipping or walking of drill bit 200 over surface 288 of formation 276 at the beginning of drilling a new borehole. With central pilot 282 being disposed within pilot hole 289, the orientation of drill bit 200 may be stabilized with respect to entry into a surface of formation 276. Accordingly, drill bit 200 may progress in forward direction 278 as central pilot 282 cuts into formation 276.

Cutting elements 226 of drill bit 200 may subsequently contact formation 276 following the initial formation of pilot hole 289 by central pilot 282. For example, as shown in FIG. 9, cutting edges of cutting elements 226 may form borehole 290 within formation 276. Borehole 290 may follow in the same forward direction 278 as pilot hole 289. Projection tip 284 of central pilot 282, which may have a substantially apical shape centered about central axis 218 and a smaller diameter than a portion of drill bit 200 including bit body 220 and cutting elements 226, may more efficiently begin cutting into subterranean formation 276 at a desired location and angle relative to surface 288 of formation 276. Additionally, central pilot 282 may facilitate cutting of borehole 290, which has a larger diameter than pilot hole 289, since central pilot 282 may guide drill bit 200 into formation 276 at a desired angle of $\theta_1$ and orientation. Skipping of drill bit 200 over surface 288 of formation 276 may also be prevented by central pilot 282, because central pilot 282 is already disposed within pilot hole 289 of formation 276 when cutting elements 272 of drill bit 200 first contact surface 288 of formation 276. Drill bit 200 may be configured to drill a borehole at a variety of angles relative to surface 288 of subterranean formation 276. According to at least one embodiment, drill bit 200 may be utilized to drill boreholes 290 at angles of $\theta_1$ ranging from approximately 30° to approximately 150° relative to surface 288 of formation 276.

Figure 10:
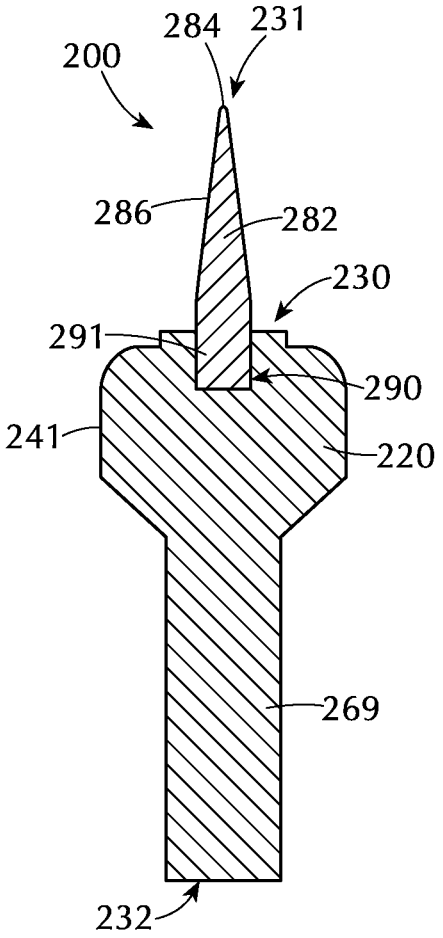
FIG. 10 is a cross-sectional side view of an exemplary drill bit according to at least one embodiment.
Figure 11:
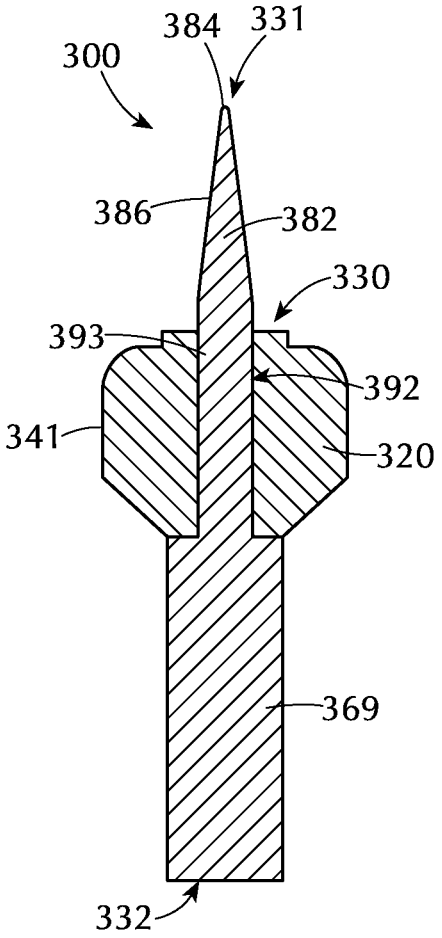
FIG. 11 is a cross-sectional side view of an exemplary drill bit according to at least one embodiment.

FIGS. 10 and 11 show cross-sectional side views of exemplary support-bolt drill bits according to various embodiments. As shown in FIG. 10, drill bit 200 may comprise a central pilot 282 that is mounted to bit body 220. Drill bit 200 may comprise a bit body 220 having a forward end 230 and a rearward end 242. According to some embodiments, a rearward coupling portion 269 of drill bit 200 may be integrally formed with bit body 220. Bit body 220 may comprise a peripheral side surface 241 and a mounting recess 290 for coupling central pilot 282 to bit body 220. Central pilot 282 may comprise a coupling extension 291 that is disposed and secured within mounting recess 290. Coupling portion 291 may comprise any suitable shape and/or configuration, without limitation, and mounting recess 290 may comprise any suitable shape for securely holding coupling portion 291 of central pilot 282. Coupling portion 291 of central pilot 282 may be configured to be temporarily or permanently coupled to bit body 220 (e.g., by threaded connection, pin connection, mechanical attachment, brazing, welding, bonding, interference fit, and/or other suitable coupling).

FIG. 11 illustrates an exemplary drill bit 300 according to some embodiments. As shown in FIG. 11, central pilot 382 may be integrally formed with another portion of drill bit 300, such as rearward coupling portion 369. Drill bit 300 may comprise a bit body 320 having a forward end 330. Drill bit 300 may also have a rearward end 332 axially spaced away from forward end 330 of bit body 320. Central pilot 382 may extend along a central axis in an axially forward direction between bit body 320 and a projection forward end 331. In some embodiments, central pilot 382 may comprise a projection tip 384 at projection forward end 331 and at least one projection face 386 located on a side of central pilot 382.

According to at least one embodiment, bit body 320 may comprise a peripheral side surface 341 and a through-hole 392 for coupling central pilot 382 and rearward coupling portion 369 to bit body 320. Central pilot 382 may be integrally formed with and/or coupled to rearward coupling portion 369 by a connection member 393 that is disposed and/or secured within through-hole 392. Connection member 393 may comprise any suitable shape and/or configuration, without limitation, and through-hole 392 may comprise any suitable shape for securely holding connection member 393. Connection member 393 may be configured to be temporarily or permanently coupled to bit body 320 (e.g., by threaded connection, pin connection, mechanical attachment, brazing, welding, bonding, interference fit, and/or other suitable coupling).

Figure 12:
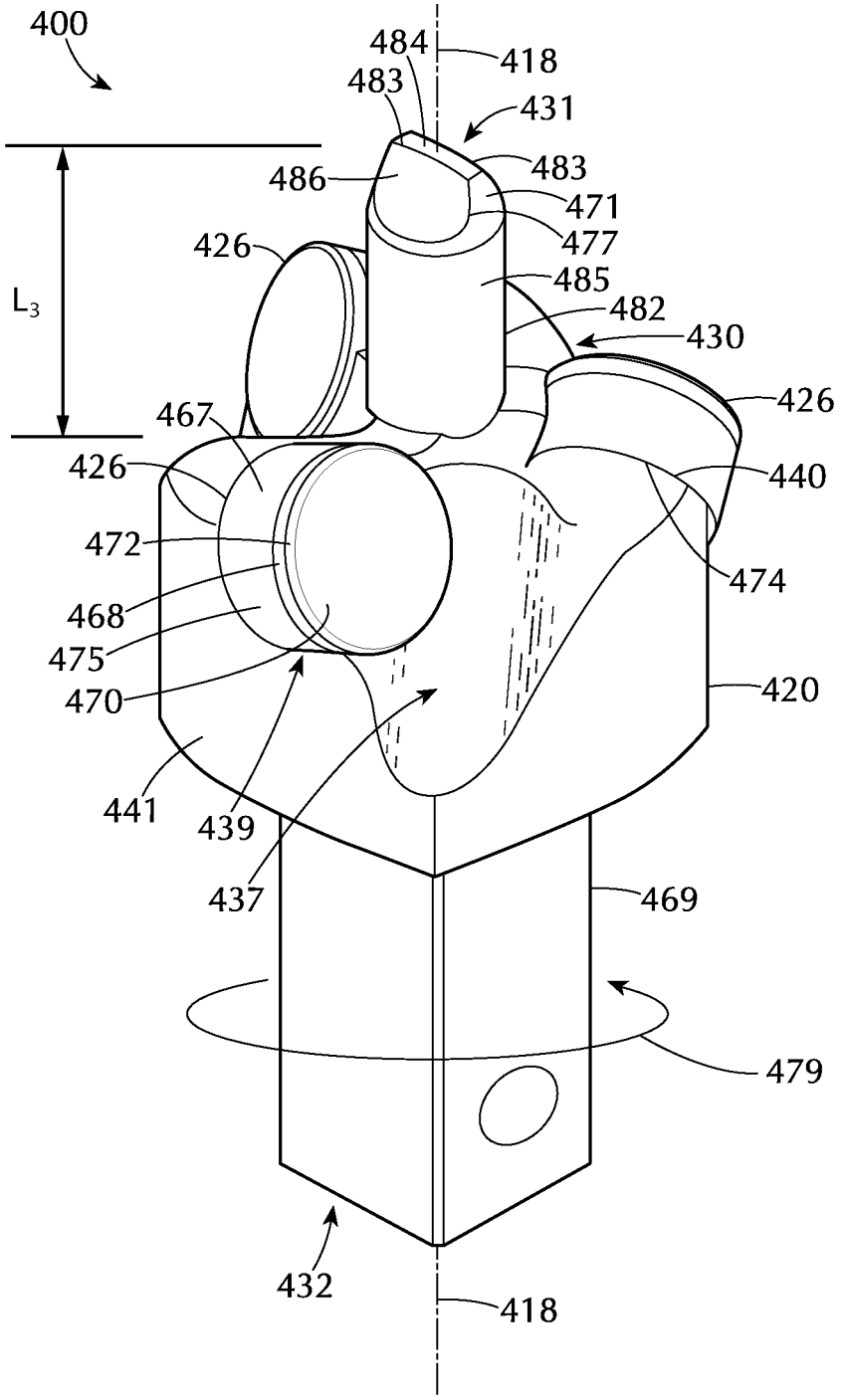
FIG. 12 is a perspective view of an exemplary drill bit according to at least one embodiment.

FIG. 12 shows a perspective view of an exemplary support-bolt drill bit 400 according to at least one embodiment. Drill bit 400 may represent any type or form of earth-boring or drilling tool, including, for example, a rotary borehole drill bit. In contrast to a coring drill bit that forms a central core of material being drilled during operation, drill bit 400 may be non-coring drill bit. For example, cutting elements 426 and central pilot 482 of drill bit 400 may cut a concave borehole without forming a central core within a distal end of a borehole during drilling.

As illustrated in FIG. 12, drill bit 400 may comprise a bit body 420 having a forward end 430 and a rearward end 432. At least one cutting element 426 may be coupled to bit body 420. Bit body 420 may comprise a rearward coupling portion 469, such as a coupling shank, having any configuration suitable for coupling with another attachment (see, e.g., drilling attachment 281 illustrated in FIGS. 8 and 9). A peripheral side surface 441 may define an outer periphery of bit body 420. In some embodiments, peripheral side surface 441 may be located radially outward from an outer surface of rearward coupling portion 469. As illustrated in FIG. 12, drill bit 400 may be centered around and/or may be rotatable about a central axis 418. Central axis 418 may extend in a lengthwise direction through drill bit 400 between forward end 430 and rearward end 432. In at least one example, drill bit 400 may comprise three cutting elements 426 that are positioned apart from each other at approximately the same interval relative to central axis 418.

Bit body 420 may also comprise at least one cutter pocket 439 for securing a cutting element 426 to bit body 420. Cutter pockets 439 may each include at least one mounting surface, such as back mounting surface 440, for securing cutting element 426 to bit body 420. Cutting elements 426 may be mounted to bit body 420 so that portions of cutting elements 426 abut cutter pockets 439. Cutting elements 426 may each comprise a layer or table 468 affixed to or formed upon a substrate 467. Table 468 may be formed of any material or combination of materials suitable for cutting subterranean formations, including, for example, a superhard or superabrasive material such as polycrystalline diamond (PCD). Similarly, substrate 467 may comprise any material or combination of materials capable of adequately supporting a superabrasive material during drilling of a subterranean formation, including, for example, cemented tungsten carbide. For example, cutting element 426 may comprise a table 468 comprising polycrystalline diamond bonded to a substrate 467 comprising cobalt-cemented tungsten carbide. In at least one embodiment, after forming table 468, a catalyst material (e.g., cobalt or nickel) may be at least partially removed from table 468 using any suitable technique, such as, for example, acid leaching.

Cutting elements 426 may each comprise a cutting face 470 formed by table 468, a peripheral surface 475 formed by table 468 and substrate 467, and a back surface 474 formed by substrate 467. According to various embodiments, cutting face 470 may be substantially planar and peripheral surface 475 may be substantially perpendicular to cutting face 470. Back surface 474 may be spaced away from and, in some embodiments, substantially parallel to cutting face 470. Back surfaces 474 of cutting elements 426 may be mounted and secured to back mounting surfaces 440 of cutter pockets 439, as shown in FIG. 12. Cutting face 470 and peripheral surface 475 may be formed in any suitable shape, without limitation. In one embodiment, cutting face 470 may have a substantially arcuate periphery. In another embodiment, cutting face 470 may have a substantially circular periphery.

As illustrated in FIG. 12, each cutting element 426 may also comprise a cutting edge having a chamfer 472 formed along at least a portion of a periphery of table 468 between cutting face 470 and peripheral surface 475. The cutting edge may also include any other suitable surface shape between cutting face 470 and peripheral surface 475, including, without limitation, an arcuate surface (e.g., a radius), a sharp edge, multiple chamfers/radii, a honed edge, and/or combinations of the foregoing. Chamfer 472 may be configured to contact and/or cut a subterranean formation as drill bit 400 is rotated relative to the formation. Bit body 420 may also comprise at least one debris channel 437. Debris channel 437 may guide debris away from a forward portion of drill bit 400. Debris channel 437 may be defined radially inward from peripheral side surface 441. Additionally, debris channel 437 may be located adjacent at least one cutting element 426.

According to various embodiments, drill bit 400 may comprise a central pilot 482 extending from bit body 420 in an axially forward direction. For example, as illustrated in FIG. 12, central pilot 482 may extend along central axis 418 in an axially forward direction between bit body 420 and a projection forward end 431. Projection forward end 431 may extend axially beyond cutting elements 426 in the axially forward direction along central axis 418. According to at least one embodiment, central pilot 482 may have a length $L_3$ of less than approximately 0.5 inches in the axial direction. According to additional embodiments, central pilot 482 may have a length $L_3$ of approximately 0.5 inches or more in the axial direction. According to various embodiments, central pilot 482 may have a length $L_3$ of between approximately 0.5 inches and approximately 1.0 inches, greater than approximately 1.0 inches, between approximately 1.0 inches and approximately 1.5 inches, between approximately 1.5 inches and approximately 2.0 inches, greater than approximately 2.0 inches, between approximately 2.0 inches and approximately 2.5 inches, between approximately 2.5 inches and approximately 3.0 inches, greater than approximately 3.0 inches, between approximately 3.0 inches and approximately 3.5 inches, between approximately 3.5 inches and approximately 4.0 inches, greater than approximately 4.0 inches, between approximately 4.0 inches and approximately 4.5 inches, between approximately 4.5 inches and approximately 5.0 inches, greater than approximately 5.0 inches, or any other suitable length, without limitation.

It is currently believed that having a central pilot with a length of greater than 1, greater than 2, or greater than 3 inches can protect the axially trailing cutting elements. In one embodiment, the central pilot comprises cobalt-cemented tungsten carbide or any other non-diamond material (e.g., a metal) and the axially trailing cutting elements comprise polycrystalline diamond or any other polycrystalline superhard material.

Central pilot 482 may comprise any suitable material or combination of materials, including, for example, hard and/or superhard materials, such as cemented tungsten carbide, polycrystalline diamond, and/or steel, without limitation. According to at least one embodiment, central pilot 482 may be integrally formed with bit body 420. In other embodiments, central pilot 482 may comprise a separate member that is coupled to bit body 420.

As shown in FIG. 12, cutting elements 426 of drill bit 400 may extend radially beyond central pilot 482 relative to central axis 418. For example, cutting edges of cutting elements 426 may extend from axially forward of bit body 420 to radially beyond central pilot 482 relative to central axis 418. In some embodiments, central pilot 482 may have a diameter that is less than a diameter of peripheral surface 441 of bit body 420.

Central pilot 482 may comprise any suitable shape and/or configuration, without limitation. According to some embodiments, central pilot 482 may have at least one cutting edge configured to cut away material, such as rock, carbonaceous material, and/or other subterranean material, during drilling. For example, as illustrated in FIG. 12, central pilot 482 may comprise a projection tip 484, which is disposed distally from bit body 420 at projection forward end 431. Projection tip 484 of central pilot 482 may comprise a forward projection surface centered about central axis 418. Central pilot 482 may also comprise at least one forward projection cutting edge 483. According to at least one embodiment, forward projection cutting edges 483 may be located at and/or adjacent projection forward end 431 of central pilot 482. Additionally, central pilot 482 may have a peripheral side surface 485 extending at least partially between bit body 420 and projection forward end 431. In some embodiments, peripheral side surface 485 may comprise an arcuate surface portion of central pilot 482. For example, peripheral side surface 485 may have a substantially cylindrical periphery.

Central pilot 482 may also comprise at least one projection face 486 and/or a sloped projection surface 471 located radially inward of peripheral side surface 485. Projection face 486 and sloped projection surface 471 may comprise any suitable shape, without limitation. For example, as illustrated in FIG. 12, projection face 486 may comprise a generally flat surface and sloped projection surface 471 may comprise an arcuate and/or generally conical or frustoconical surface. According to at least one embodiment, a forward projection cutting edge 483 may be located at a forward portion of each projection face 486. A projection face edge 477 may also be located on a periphery of projection face 486. For example, projection face edge 477 may be located at an intersection of projection face 486 and sloped projection surface 471. According to some embodiments, projection face edge 477 may also act as a cutting edge configured to remove material from a side and/or forward portion of a borehole during drilling. Forward projection cutting edges 483 and/or projection face peripheral edges 477 may comprise any suitable edge shape, including, without limitation, a sharp edge, a chamfered edge, an arcuate surface (e.g., a radius), multiple chamfers/radii, a honed edge, and/or combinations of the foregoing. Forward projection cutting edges 483 and/or projection face peripheral edges 477 may be configured to contact and/or cut a subterranean formation as drill bit 400 is rotated relative to the formation.

According to various embodiments, during drilling, central pilot 482 may contact a subterranean formation prior to bit body 420 and cutting elements 426, even when drill bit 400 is oriented at a non-perpendicular angle relative to a surface of the formation (see, e.g., FIGS. 8 and 9). Accordingly, as drill bit 400 is forced against a subterranean formation in both an axially forward direction and a rotational direction 479 during drilling, central pilot 482 may cut into the formation to form a pilot hole 489. Central pilot 482 may have a length such that, when central pilot 482 is placed in contact with a surface of a subterranean formation, cutting elements 426 of drill bit 400 do not contact the formation. Accordingly, central pilot 482 may begin drilling of a pilot hole without cutting elements 426 contacting the formation. Projection tip 484 of central pilot 482, which may have a smaller diameter than a portion of drill bit 400 that includes bit body 420 and cutting elements 426, may facilitate an efficient and controlled entry of drill bit 400 into a subterranean formation, while preventing skipping or walking of drill bit 400 over a surface of the formation at the beginning of drilling a new borehole. Accordingly, the orientation of drill bit 400 may be stabilized with respect to entry into a surface of the formation.

Cutting elements 426 of drill bit 400 may subsequently contact the formation following the initial formation of a pilot hole by central pilot 482. For example, cutting edges of cutting elements 426 may form a borehole within the formation. Such a borehole formed by cutting elements 426 may follow in the same forward direction as a pilot hole formed by central pilot 482. Projection tip 484 of central pilot 482, which may have a smaller diameter than a portion of drill bit 400 that includes bit body 420 and cutting elements 426, may more efficiently begin cutting into a subterranean formation at a desired location and angle relative to a surface of the formation. Additionally, central pilot 482 may facilitate cutting of a borehole as central pilot 482 guides drill bit 400 into formation 476 at the desired angle and orientation. Skipping of drill bit 400 over a surface of a formation may also be prevented by central pilot 482. Drill bit 400 may be configured to drill boreholes at a variety of angles relative to a surface of subterranean formation 476. According to at least one embodiment, drill bit 400 may be utilized to drill boreholes 490 at angles ranging from approximately 30° to approximately 150° (as shown in FIGS. 8 and 9) relative to a surface of a formation.

Figure 13:
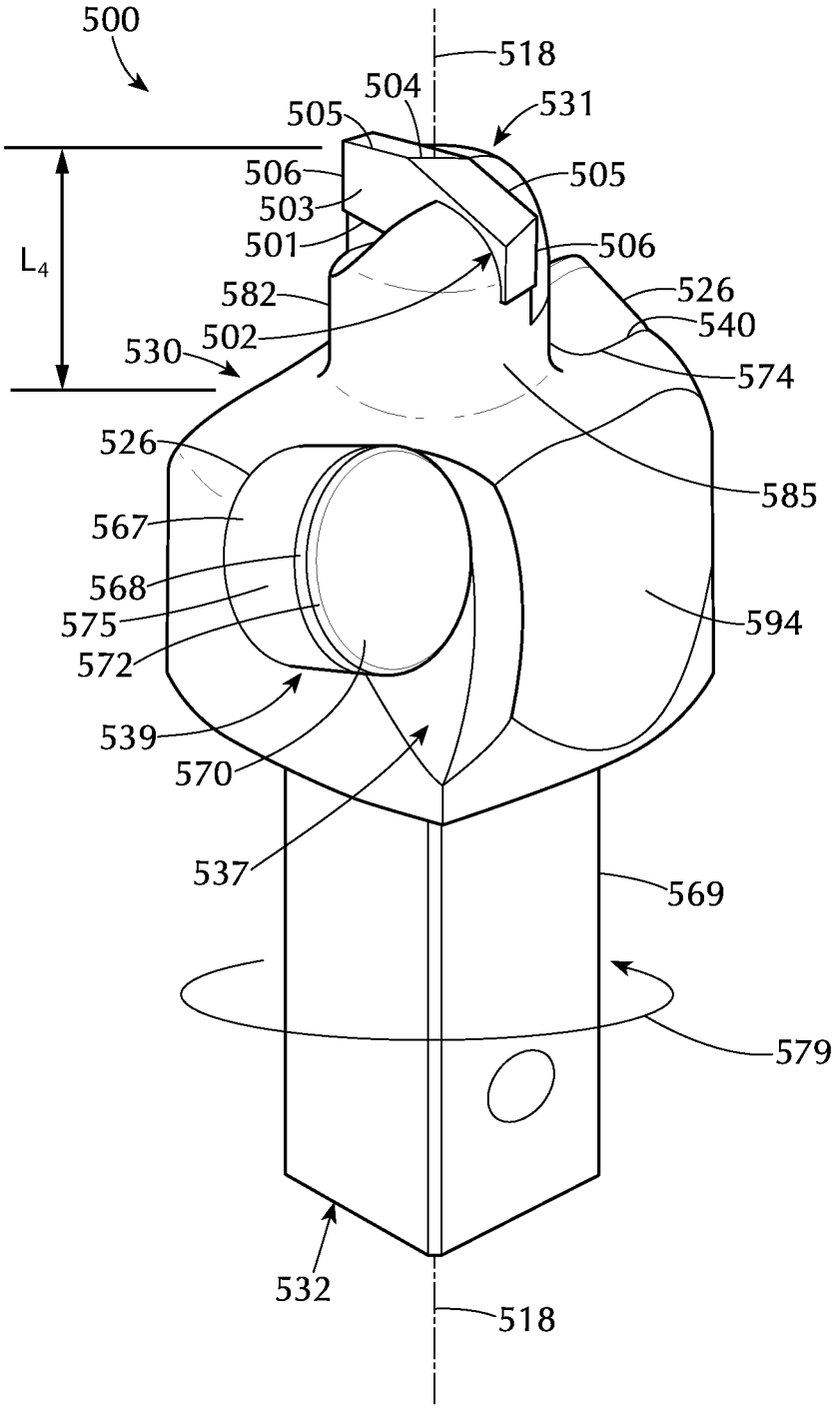
FIG. 13 is a perspective view of an exemplary drill bit according to at least one embodiment.

FIG. 13 shows a perspective view of an exemplary support-bolt drill bit 500 according to at least one embodiment. Drill bit 500 may represent any type or form of earth-boring or drilling tool, including, for example, a rotary borehole drill bit. In contrast to a coring drill bit that forms a central core of material being drilled during operation, drill bit 500 may be non-coring drill bit. For example, cutting elements 526 and projection cutting element 501 of drill bit 500 may cut a concave borehole without forming a central core within a distal end of a borehole during drilling.

As illustrated in FIG. 13, drill bit 500 may comprise a bit body 520 having a forward end 530 and a rearward end 532. At least one cutting element 526 may be coupled to bit body 520. Bit body 520 may comprise a rearward coupling portion 569, such as a coupling shank, having any configuration suitable for coupling with another attachment (see, e.g., drilling attachment 281 illustrated in FIGS. 8 and 9). A peripheral side surface 541 may define an outer periphery of bit body 520. In some embodiments, peripheral side surface 541 may be located radially outward from an outer surface of rearward coupling portion 569. As illustrated in FIG. 13, drill bit 500 may be centered around and/or may be rotatable about a central axis 518. Central axis 518 may extend in a lengthwise direction through drill bit 500 between forward end 530 and rearward end 532. In at least one example, drill bit 500 may comprise two cutting elements 526 that are positioned approximately 180° apart from each other relative to central axis 518.

Bit body 520 may also comprise at least one cutter pocket 539 for securing a cutting element 526 to bit body 520. Cutter pockets 539 may each include at least one mounting surface, such as back mounting surface 540. Cutting elements 526 may be mounted to bit body 520 so that portions of cutting elements 526 abut cutter pockets 539. Cutting elements 526 may each comprise a layer or table 568 affixed to or formed upon a substrate 567. Table 568 may be formed of any material or combination of materials suitable for cutting subterranean formations, including, for example, a superhard or superabrasive material such as polycrystalline diamond (PCD). Similarly, substrate 567 may comprise any material or combination of materials capable of adequately supporting a superabrasive material during drilling of a subterranean formation, including, for example, cemented tungsten carbide. For example, cutting element 526 may comprise a table 568 comprising polycrystalline diamond bonded to a substrate 567 comprising cobalt-cemented tungsten carbide. In at least one embodiment, after forming table 568, a catalyst material (e.g., cobalt or nickel) may be at least partially removed from table 568 using any suitable technique, such as, for example, acid leaching.

Cutting elements 526 may each comprise a cutting face 570 formed by table 568, a peripheral surface 575 formed by table 568 and substrate 567, and a back surface 574 formed by substrate 567. According to various embodiments, cutting face 570 may be substantially planar and peripheral surface 575 may be substantially perpendicular to cutting face 570. Back surface 574 may be spaced away from and, in some embodiments, substantially parallel to cutting face 570. Back surfaces 574 of cutting elements 526 may be mounted and secured to back mounting surfaces 540 of cutter pockets 539, as shown in FIG. 13. Cutting face 570 and peripheral surface 575 may be formed in any suitable shape, without limitation. In one embodiment, cutting face 570 may have a substantially arcuate periphery. In another embodiment, cutting face 570 may have a substantially circular periphery.

As illustrated in FIG. 13, each cutting element 526 may also comprise a cutting edge having a chamfer 572 formed along at least a portion of a periphery of table 568 between cutting face 570 and peripheral surface 575. The cutting edge may also include any other suitable surface shape between cutting face 570 and peripheral surface 575, including, without limitation, an arcuate surface (e.g., a radius), a sharp edge, multiple chamfers/radii, a honed edge, and/or combinations of the foregoing. Chamfer 572 may be configured to contact and/or cut a subterranean formation as drill bit 500 is rotated relative to the formation. Bit body 520 may also comprise at least one debris channel 537. Debris channel 537 may guide debris away from a forward portion of drill bit 500. Debris channel 537 may be defined radially inward from peripheral side surface 541. Additionally, debris channel 537 may be located adjacent at least one cutting element 526.

According to various embodiments, drill bit 500 may comprise a central pilot 582 extending from bit body 520 in an axially forward direction. For example, as illustrated in FIG. 13, central pilot 582 may extend along central axis 518 in an axially forward direction between a main portion of bit body 520 and a projection forward end 531. Projection forward end 531 may extend axially beyond cutting elements 526 in the axially forward direction along central axis 518. According to at least one embodiment, central pilot 582 may have a length L4 of less than approximately 0.5 inches in the axial direction. According to additional embodiments, central pilot 582 may have a length L4 of approximately 0.5 inches or more in the axial direction. According to various embodiments, central pilot 582 may have a length L4 of between approximately 0.5 inches and approximately 1.0 inches, greater than approximately 1.0 inches, between approximately 1.0 inches and approximately 1.5 inches, between approximately 1.5 inches and approximately 2.0 inches, greater than approximately 2.0 inches, between approximately 2.0 inches and approximately 2.5 inches, between approximately 2.5 inches and approximately 3.0 inches, greater than approximately 3.0 inches, between approximately 3.0 inches and approximately 3.5 inches, between approximately 3.5 inches and approximately 4.0 inches, greater than approximately 4.0 inches, between approximately 4.0 inches and approximately 4.5 inches, between approximately 4.5 inches and approximately 5.0 inches, greater than approximately 5.0 inches, or any other suitable length, without limitation.

It is currently believed that having a central pilot with a length of greater than 1, greater than 2, or greater than 3 inches can protect the axially trailing cutting elements. In one embodiment, the central pilot comprises cobalt-cemented tungsten carbide or any other non-diamond material (e.g., a metal) and the axially trailing cutting elements comprise polycrystalline diamond or any other polycrystalline superhard material.

Central pilot 582 may comprise any suitable material or combination of materials, including, for example, hard and/or superhard materials, such as cemented tungsten carbide, polycrystalline diamond, and/or steel, without limitation. According to at least one embodiment, central pilot 582 may be integrally formed with bit body 520. In other embodiments, central pilot 582 may comprise a separate member that is coupled to bit body 520.

As shown in FIG. 13, cutting elements 526 of drill bit 500 may extend radially beyond central pilot 582 relative to central axis 518. For example, cutting edges of cutting elements 526 may extend from axially forward of bit body 520 to radially beyond central pilot 582 relative to central axis 518. In some embodiments, central pilot 582 may have a diameter that is less than a diameter of peripheral surface 541 of bit body 520. Central pilot 582 may have a peripheral side surface 585 extending at least partially between bit body 520 and projection forward end 531. In some embodiments, peripheral side surface 585 may comprise an arcuate surface portion of central pilot 582. For example, peripheral side surface 585 may have a substantially cylindrical periphery.

Central pilot 582 may comprise any suitable shape and/or configuration, without limitation. According to some embodiments, central pilot 582 may comprise a projection cutting element 501 mounted in a mounting recess 502. In at least one embodiment, central pilot 582 may comprise a projection cutting element 501 that is substantially centered about central axis 518. Projection cutting element 501 may be formed of any material or combination of materials suitable for cutting a subterranean formation material, including, for example, cobalt-cemented tungsten carbide, polycrystalline diamond (PCD), and/or any other suitable material. According to at least one embodiment, cutting element 501 may comprise a PCD table formed on a substrate. For example, a PCD table of cutting element 501 may be positioned and formed so as to define one or more portions of cutting element 501, such as cutting faces 503, cutting tip 504, forward cutting edges 505, and/or cutting edges 506, without limitation.

Projection cutting element 501 may comprise at least one cutting face 503. For example, projection cutting element 501 may include two cutting faces 503 on opposite sides of projection cutting element 501. Each cutting face 503 may face generally in a rotational direction 579 of drill bit 500. Projection cutting element 501 may additionally comprise a cutting tip 504 located at projection forward end 531. Cutting tip 504 of cutting element 501 may comprise a forward projection surface and/or edge centered about central axis 518. Projection cutting element 501 may also have at least one cutting edge configured to cut away material, such as rock material, carbonaceous material, and/or other subterranean material, during drilling. For example, as illustrated in FIG. 13, cutting element 501 may comprise at least one forward cutting edge 505. According to at least one embodiment, forward cutting edges 505 may be located at and/or adjacent projection forward end 531 of central pilot 582. A side cutting edge 506 may also be located on a periphery of each cutting face 503. According to some embodiments, side cutting edges 506 may act as cutting edges configured to remove material from a side portion of a borehole during drilling. Forward cutting edges 505 and/or side cutting edges 506 may comprise any suitable edge shape, including, without limitation, a sharp edge, a chamfered edge, an arcuate surface (e.g., a radius), multiple chamfers/radii, a honed edge, and/or combinations of the foregoing. Forward cutting edges 505 and/or side cutting edges 506 may be configured to contact and/or cut a subterranean formation as drill bit 500 is rotated relative to the subterranean formation.

According to various embodiments, during drilling, central pilot 582 may contact a subterranean formation prior to bit body 520 and cutting elements 526, even when drill bit 500 is oriented at a non-perpendicular angle relative to a surface of the formation (see, e.g., FIGS. 8 and 9). Accordingly, as drill bit 500 is forced against a subterranean formation in both an axially forward direction and a rotational direction during drilling, projection cutting element 501 of central pilot 582 may cut into the formation to form a pilot hole 589. Central pilot 582 may have a length such that, when central pilot 582 is placed in contact with a surface of a subterranean formation, cutting elements 526 of drill bit 500 do not contact the formation. Accordingly, central pilot 582 may begin drilling of a pilot hole without cutting elements 526 contacting the formation. Cutting tip 504 of central pilot 582, which may have a smaller diameter than a portion of drill bit 500 that includes cutting elements 526, may facilitate an efficient and controlled entry of drill bit 500 into a subterranean formation, while preventing skipping or walking of drill bit 500 over a surface of the formation at the beginning of drilling a new borehole. Accordingly, the orientation of drill bit 500 may be stabilized with respect to entry into a surface of the formation.

Cutting elements 526 of drill bit 500 may subsequently contact the formation following the initial formation of a pilot hole by central pilot 582. For example, cutting edges of cutting elements 526 may form a borehole within the formation. Such a borehole formed by cutting elements 526 may follow in the same forward direction as a pilot hole formed by central pilot 582. Projection tip 584 of central pilot 582, which may have a smaller diameter than a portion of drill bit 500 that includes bit body 520 and cutting elements 526, may more efficiently begin cutting into a subterranean formation at a desired location and angle relative to a surface of the formation. Additionally, central pilot 582 may facilitate cutting of a borehole as central pilot 582 guides drill bit 500 into formation 576 at the desired angle and orientation. Drill bit 500 may be configured to drill boreholes at a variety of angles relative to a surface of subterranean formation 576. According to at least one embodiment, drill bit 500 may be utilized to drill boreholes 590 at angles ranging from approximately 30° to approximately 150° (as shown in FIGS. 8 and 9) relative to a surface of a formation.

Figure 14:
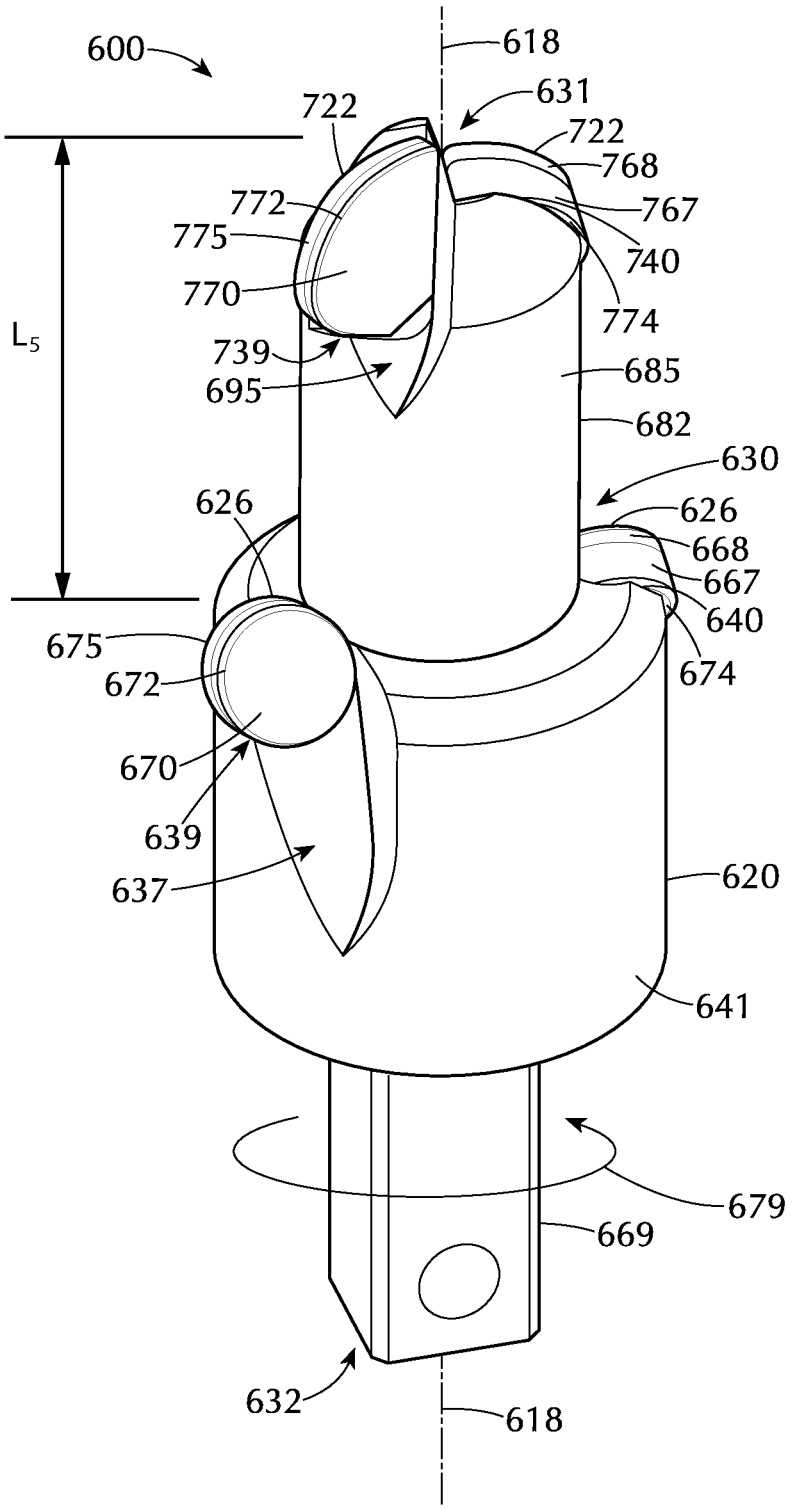
FIG. 14 is a perspective view of an exemplary drill bit according to at least one embodiment.

FIG. 14 shows a perspective view of an exemplary support-bolt drill bit 600 according to at least one embodiment. Drill bit 600 may represent any type or form of earth-boring or drilling tool, including, for example, a rotary borehole drill bit. In contrast to a coring drill bit that forms a central core of material being drilled during operation, drill bit 600 may be non-coring drill bit. For example, cutting elements 626 and central pilot 682 of drill bit 600 may cut a concave borehole without forming a central core within a distal end of a borehole during drilling.

As illustrated in FIG. 14, drill bit 600 may comprise a bit body 620 having a forward end 630 and a rearward end 632. At least one cutting element 626 may be coupled to bit body 620. Bit body 620 may comprise a rearward coupling portion 669, such as a coupling shank, having any configuration suitable for coupling with another attachment (see, e.g., drilling attachment 281 illustrated in FIGS. 8 and 9). A peripheral side surface 641 may define an outer periphery of bit body 620. In some embodiments, peripheral side surface 641 may be located radially outward from an outer surface of rearward coupling portion 669. As illustrated in FIG. 14, drill bit 600 may be centered around and/or may be rotatable about a central axis 618. Central axis 618 may extend in a lengthwise direction through drill bit 600 between forward end 630 and rearward end 632. In at least one example, drill bit 600 may comprise two cutting elements 626 that are positioned approximately 180° apart from each other relative to central axis 618.

Bit body 620 may also comprise at least one cutter pocket 639 for securing a cutting element 626 to bit body 620. Cutter pockets 639 may each include at least one mounting surface, such as back mounting surface 640. Cutting elements 626 may be mounted to bit body 620 so that portions of cutting elements 626 abut cutter pockets 639. Cutting elements 626 may each comprise a layer or table 668 affixed to or formed upon a substrate 667. Table 668 may be formed of any material or combination of materials suitable for cutting subterranean formations, including, for example, a superhard or superabrasive material such as polycrystalline diamond (PCD). Similarly, substrate 667 may comprise any material or combination of materials capable of adequately supporting a superabrasive material during drilling of a subterranean formation, including, for example, cemented tungsten carbide. For example, cutting element 626 may comprise a table 668 comprising polycrystalline diamond bonded to a substrate 667 comprising cobalt-cemented tungsten carbide. In at least one embodiment, after forming table 668, a catalyst material (e.g., cobalt or nickel) may be at least partially removed from table 668 using any suitable technique, such as, for example, acid leaching.

Cutting elements 626 may each comprise a cutting face 670 formed by table 668, a peripheral surface 675 formed by table 668 and substrate 667, and a back surface 674 formed by substrate 667. According to various embodiments, cutting face 670 may be substantially planar and peripheral surface 675 may be substantially perpendicular to cutting face 670. Back surface 674 may be spaced away from and, in some embodiments, substantially parallel to cutting face 670. Back surfaces 674 of cutting elements 626 may be mounted and secured to back mounting surfaces 640 of cutter pockets 639, as shown in FIG. 14. Cutting face 670 and peripheral surface 675 may be formed in any suitable shape, without limitation. In one embodiment, cutting face 670 may have a substantially arcuate periphery. In another embodiment, cutting face 670 may have a substantially circular periphery.

As illustrated in FIG. 14, each cutting element 626 may also comprise a cutting edge having a chamfer 672 formed along at least a portion of a periphery of table 668 between cutting face 670 and peripheral surface 675. The cutting edge may also include any other suitable surface shape between cutting face 670 and peripheral surface 675, including, without limitation, an arcuate surface (e.g., a radius), a sharp edge, multiple chamfers/radii, a honed edge, and/or combinations of the foregoing. Chamfer 672 may be configured to contact and/or cut a subterranean formation as drill bit 600 is rotated relative to the formation. Bit body 620 may also comprise at least one debris channel 637. Debris channel 637 may guide debris away from a forward portion of drill bit 600. Debris channel 637 may be defined radially inward from peripheral side surface 641. Additionally, debris channel 637 may be located adjacent at least one cutting element 626.

According to various embodiments, drill bit 600 may comprise a central pilot 682 extending from bit body 620 in an axially forward direction. For example, as illustrated in FIG. 14, central pilot 682 may extend along central axis 618 in an axially forward direction between bit body 620 and a projection forward end 631. Projection forward end 631 may extend axially beyond cutting elements 626 in the axially forward direction along central axis 618. According to at least one embodiment, central pilot 682 may have a length $L_5$ of less than approximately 0.5 inches in the axial direction. According to additional embodiments, central pilot 682 may have a length $L_5$ of approximately 0.5 inches or more in the axial direction. According to various embodiments, central pilot 682 may have a length $L_5$ of between approximately 0.5 inches and approximately 1.0 inches, greater than approximately 1.0 inches, between approximately 1.0 inches and approximately 1.5 inches, between approximately 1.5 inches and approximately 2.0 inches, greater than approximately 2.0 inches, between approximately 2.0 inches and approximately 2.5 inches, between approximately 2.5 inches and approximately 3.0 inches, greater than approximately 3.0 inches, between approximately 3.0 inches and approximately 3.5 inches, between approximately 3.5 inches and approximately 4.0 inches, greater than approximately 4.0 inches, between approximately 4.0 inches and approximately 4.5 inches, between approximately 4.5 inches and approximately 5.0 inches, greater than approximately 5.0 inches, or any other suitable length, without limitation. It is currently believed that having a central pilot with a length of greater than 1, greater than 2, or greater than 3 inches can protect the axially trailing cutting elements.

Central pilot 682 may comprise any suitable material or combination of materials, including, for example, hard and/or superhard materials, such as cemented tungsten carbide, polycrystalline diamond, and/or steel, without limitation. According to at least one embodiment, central pilot 682 may be integrally formed with bit body 620. In other embodiments, central pilot 682 may comprise a separate member that is coupled to bit body 620.

As shown in FIG. 14, cutting elements 626 of drill bit 600 may extend radially beyond central pilot 682 relative to central axis 618. For example, cutting edges of cutting elements 626 may extend from axially forward of bit body 620 to radially beyond central pilot 682 relative to central axis 618. In some embodiments, central pilot 682 may have a diameter that is less than a diameter of peripheral surface 641 of bit body 620.

Central pilot 682 may comprise any suitable shape and/or configuration, without limitation. According to some embodiments, central pilot 682 may comprise at least one projection cutting element 722 mounted in corresponding cutter pockets 739. Cutter pockets 739 may each include at least one mounting surface, such as back mounting surface 740, for securing projection cutting element 722 to bit body 720. Projection cutting elements 722 may be mounted to central pilot 682 so that portions of projection cutting elements 722 abut cutter pockets 739. According to some embodiments, projection cutting elements 722 may each comprise a layer or table 768 affixed to or formed upon a substrate 767. Table 768 may be formed of any material or combination of materials suitable for cutting subterranean formations, including, for example, a superhard or superabrasive material such as polycrystalline diamond (PCD). Similarly, substrate 767 may comprise any material or combination of materials capable of adequately supporting a superabrasive material during drilling of a subterranean formation, including, for example, cemented tungsten carbide. For example, projection cutting element 722 may comprise a table 768 comprising polycrystalline diamond bonded to a substrate 767 comprising cobalt-cemented tungsten carbide. In at least one embodiment, after forming table 768, a catalyst material (e.g., cobalt or nickel) may be at least partially removed from table 768 using any suitable technique, such as, for example, acid leaching.

Projection cutting elements 722 may each comprise a cutting face 770 formed by table 768, a side surface 775 formed by table 768 and substrate 767, and a back surface 774 formed by substrate 767. According to various embodiments, cutting face 770 may be substantially planar and side surface 775 may be substantially perpendicular to cutting face 770. Back surface 774 may be spaced away from and, in some embodiments, substantially parallel to cutting face 770. Back surfaces 774 of cutting elements 722 may be mounted and secured to back mounting surfaces 740 of cutter pockets 739, as shown in FIG. 14. Cutting face 770 and side surface 775 may be formed in any suitable shape, without limitation. In at least one embodiment, cutting face 770 may have a partially arcuate periphery. In another embodiment, cutting face 770 may have a substantially semi-circular periphery. For example, two cutting elements 722 may be cut from a single substantially circular cutting element blank, resulting in two generally semi-circular cutting elements 722. In some embodiments, angular portions of peripheral surface 775 may be rounded to form a substantially arcuate surface around cutting element 722.

As illustrated in FIG. 14, each projection cutting element 722 may also comprise a cutting edge having a chamfer 772 formed along at least a portion of a periphery of table 768 between cutting face 770 and side surface 775. The cutting edge may include any surface shape between cutting face 770 and side surface 775, including, without limitation, an arcuate surface (e.g., a radius), a sharp edge, multiple chamfers/radii, a honed edge, and/or combinations of the foregoing. Chamfer 772 may be configured to contact and/or cut a subterranean formation as drill bit 700 is rotated relative to the formation. Bit body 720 may also comprise at least one debris channel 739. Debris channel 739 may guide debris away from projection forward end 631 of central pilot 682. Additionally, debris channel 739 may be located adjacent at least one projection cutting element 722. Cutting edges of cutting elements 722 may be configured to contact and/or cut a subterranean formation as drill bit 600 is rotated relative to the formation. According to at least one embodiment, cutting elements 722 may be positioned on central pilot 682 so as to form a generally apical cutting tip centered about central axis 618.

According to various embodiments, during drilling, central pilot 682 may contact a subterranean formation prior to bit body 620 and cutting elements 626, even when drill bit 600 is oriented at a non-perpendicular angle relative to a surface of the formation (see, e.g., FIGS. 8 and 9). Accordingly, as drill bit 600 is forced against a subterranean formation in both a forward direction and a rotational direction 679 during drilling, central pilot 682 may cut into the formation to form a pilot hole 689. Central pilot 682 may have a length such that, when central pilot 682 is placed in contact with a surface of a subterranean formation, cutting elements 626 of drill bit 600 do not contact the formation. Accordingly, central pilot 682 may begin drilling of a pilot hole without cutting elements 626 contacting the formation. Projection forward end 631 of central pilot 682, which may have a smaller diameter than a portion of drill bit 600 that includes bit body 620 and cutting elements 626, may facilitate an efficient and controlled entry of drill bit 600 into a subterranean formation, while preventing skipping or walking of drill bit 600 over a surface of the formation at the beginning of drilling a new borehole. Accordingly, the orientation of drill bit 600 may be stabilized with respect to entry into a surface of the formation.

Cutting elements 626 of drill bit 600 may subsequently contact the formation following the initial formation of a pilot hole by central pilot 682. For example, cutting edges of cutting elements 626 may form a borehole within the formation. Such a borehole formed by cutting elements 626 may follow in the same forward direction as a pilot hole formed by central pilot 682. Projection forward end 631 of central pilot 682, which may have a smaller diameter than a portion of drill bit 600 that includes bit body 620 and cutting elements 626, may more efficiently begin cutting into a subterranean formation at a desired location and angle relative to a surface of the formation. Additionally, central pilot 682 may facilitate cutting of a borehole as central pilot 682 guides drill bit 600 into formation 676 at the desired angle and orientation. Drill bit 600 may be configured to drill boreholes at a variety of angles relative to a surface of subterranean formation 676. According to at least one embodiment, drill bit 600 may be utilized to drill boreholes 690 at angles ranging from approximately 30° to approximately 150° (as shown in FIGS. 8 and 9) relative to a surface of a formation.

The preceding description has been provided to enable others skilled the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A subterranean support-bolt drilling assembly, comprising:

a drill bit rotatable about a central axis, the drill bit having a forward end and a rearward end axially spaced away from the forward end, the drill bit comprising:

a bit body;

at least one bit cutting element bonded to the bit body, the at least one bit cutting element comprising:

a substrate;

a polycrystalline diamond table;

a spacer coupled to the rearward end of the drill bit, the spacer extending axially rearward from the drill bit;

a reamer member coupled to a rearward end of the spacer, the reamer member comprising:

a reamer body defining at least one cutter pocket;

at least one reamer cutting element bonded to the reamer body within the at least one cutter pocket, the at least one reamer cutting element comprising:

a substrate;

a polycrystalline diamond table comprising a cutting edge that extends radially beyond an outer peripheral portion of the drill bit relative to the central axis, wherein an axial length of the spacer between the drill bit and the reamer member is longer than the drill bit in the axial direction.

2. The subterranean support-bolt drilling assembly of claim 1, wherein the drill bit and the spacer have a combined length of approximately 12 inches or more in the axial direction.

3. The subterranean support-bolt drilling assembly of claim 1, wherein a maximum diameter of the reamer member exceeds a maximum diameter of the drill bit by approximately 1 mm or more with respect to the central axis.

4. The subterranean support-bolt drilling assembly of claim 1, wherein the at least one bit cutting element comprises a cutting edge.

5. The subterranean support-bolt drilling assembly of claim 1, wherein the at least one bit cutting element is positioned adjacent the central axis such that the drill bit does not generate a core in a borehole created by the rotary drill bit during drilling.

6. The subterranean support-bolt drilling assembly of claim 1, wherein the at least one reamer cutting element extends radially beyond a surface of the reamer body.

7. The subterranean support-bolt drilling assembly of claim 6, wherein the at least one reamer cutting element extends radially beyond at least a portion of a sloped surface extending between a smaller diameter portion and a larger diameter portion of the reamer body.

8. The subterranean support-bolt drilling assembly of claim 1, wherein an internal passage is defined within the spacer, the internal passage being configured to convey cutting debris from the drill bit.

9. The subterranean support-bolt drilling assembly of claim 1, wherein the at least one reamer cutting element has an arcuate periphery.

10. The subterranean support-bolt drilling assembly of claim 1, wherein the polycrystalline diamond table of the at least one reamer cutting element comprises a cutting face and the cutting edge of the at least one reamer cutting element surrounds at least a portion of the cutting face.

11. A subterranean support-bolt drilling assembly, comprising:

a drill bit rotatable about a central axis, the drill bit having a forward end and a rearward end axially spaced away from the forward end, the drill bit comprising:

a bit body;

at least one bit cutting element bonded to the bit body, the at least one bit cutting element comprising:

a substrate:

a polycrystalline diamond table;

a spacer coupled to the rearward end of the drill bit, the spacer extending axially rearward from the drill bit;

a reamer member coupled to a rearward end of the spacer, the reamer member comprising:

a reamer body defining at least one cutter pocket;

at least one reamer cutting element bonded to the reamer body within the at least one cutter pocket, the at least one reamer cutting element comprising:

a substrate;

a polycrystalline diamond table comprising a cutting edge that extends radially beyond an outer peripheral portion of the drill bit relative to the central axis, wherein an internal passage is defined within the spacer.

12. The subterranean support-bolt drilling assembly of claim 11, wherein the spacer does not include an opening extending between a peripheral side surface of the spacer and the internal passage.

13. The subterranean support-bolt drilling assembly of claim 11, wherein the internal passage is configured to convey cutting debris from the drill bit.

14. The subterranean support-bolt drilling assembly of claim 11, wherein an axial length of the spacer between the drill bit and the reamer member is longer than the drill bit in the axial direction.

15. The subterranean support-bolt drilling assembly of claim 11, wherein the spacer comprises a substantially cylindrical shape.

16. A subterranean support-bolt drilling assembly, comprising:

a drill bit comprising:

a bit body rotatable about a central axis, the bit body having a forward end and a rearward end axially spaced away from the forward end;

two bit cutting elements bonded to the bit body, each of the two bit cutting elements comprising:

a substrate;

a polycrystalline diamond table;

a spacer coupled to the rearward end of the drill bit, the spacer extending axially rearward from the drill bit;

a reamer member coupled to a rearward end of the spacer, the reamer member comprising:

a reamer body defining at least one cutter pocket;

at least one reamer cutting element bonded to the reamer body within the at least one cutter pocket, the at least one reamer cutting element comprising:

a substrate;

a polycrystalline diamond table comprising a cutting edge that extends radially beyond an outer peripheral portion of the drill bit relative to the central axis, a drill steel coupled to a rearward end of the reamer member.

17. The subterranean support-bolt drilling assembly of claim 16, wherein an axial length of the spacer between the drill bit and the reamer member is longer than the drill bit in the axial direction.

18. The subterranean support-bolt drilling assembly of claim 16, wherein an internal passage is defined within the spacer, the internal passage being configured to convey cutting debris from the drill bit.

19. The subterranean support-bolt drilling assembly of claim 16, wherein the at least one reamer cutting element extends radially beyond a surface of the reamer body.

20. The subterranean support-bolt drilling assembly of claim 19, wherein the at least one reamer cutting element extends radially beyond at least a portion of a sloped surface extending between a smaller diameter portion and a larger diameter portion of the reamer body.

* * * * *